US005966573A

United States Patent [19]

Yu et al.

[11] Patent Number: 5,966,573

[45] Date of Patent: Oct. 12, 1999

[54] SEAMED FLEXIBLE ELECTROSTATOGRAPHIC IMAGING BELT HAVING A PERMANENT LOCALIZED SOLID ATTRIBUTE

[75] Inventors: Robert C.U. Yu; Robert A. Koontz, both of Webster; Ralph A. Shoemaker, Rochester; Satchidanand Mishra, Webster; Donald C. VonHoene, Fairport; Richard L. Post, Penfield; Anthony M. Horgan, Pittsford; Bing R. Hsieh; Edward F. Grabowski, both of Webster, all of N.Y.

[73] Assignee: Xerox Corporation, Stamford, Conn.

[21] Appl. No.: 09/168,834

[22] Filed: Oct. 8, 1998

[51] Int. Cl.[6] ..... G03G 15/00

[52] U.S. Cl. ..... 399/160; 399/49; 399/162; 430/56

[58] Field of Search ..... 399/162, 160, 399/9, 49, 394; 430/56; 347/115, 116

[56] References Cited

U.S. PATENT DOCUMENTS

| | | | |
|---|---|---|---|
| 4,318,610 | 3/1982 | Grace | 399/49 |
| 4,553,033 | 11/1985 | Hubble, III et al. | 250/353 |
| 4,950,905 | 8/1990 | Butler et al. | 250/358.1 |
| 4,989,985 | 2/1991 | Hubble, III et al. | 356/445 |
| 5,053,822 | 10/1991 | Butler | 399/74 |
| 5,119,132 | 6/1992 | Butler | 399/49 |
| 5,255,055 | 10/1993 | Mahoney | 399/160 |
| 5,291,245 | 3/1994 | Charnitski et al. | 399/51 |
| 5,394,223 | 2/1995 | Hart et al. | 399/165 |
| 5,455,136 | 10/1995 | Yu et al. | 399/162 X |
| 5,519,497 | 5/1996 | Hubble, III et al. | 356/445 |
| 5,574,527 | 11/1996 | Folkins | 399/9 |
| 5,629,760 | 5/1997 | Hayashi et al. | 399/394 X |
| 5,648,809 | 7/1997 | Kato et al. | 347/115 |
| 5,652,946 | 7/1997 | Scheuer et al. | 399/49 |
| 5,708,916 | 1/1998 | Mestha | 399/49 |
| 5,710,958 | 1/1998 | Raj | 399/49 |
| 5,714,290 | 2/1998 | Yu et al. | 430/56 |
| 5,773,827 | 6/1998 | Yazdy et al. | 250/341.8 |
| 5,842,080 | 11/1998 | Ashibe et al. | 399/49 |

*Primary Examiner*—Robert Beatty
*Assistant Examiner*—Sophia S. Chen

[57] ABSTRACT

A flexible electrostatographic imaging belt having two parallel sides and a non imaging seam region extending substantially from one of the sides to the other side, the non-imaging seam region having a leading edge, a trailing edge and a seam within the non imaging seam region, the leading and trailing edges being perpendicular to the two parallel sides of the imaging belt, the belt comprising a substrate layer, a reflective electrically conductive layer, at least one imaging layer, an imaging region extending around the belt from adjacent the leading edge of the seam region to adjacent the trailing edge, the imaging region adapted to reflect monochromatic infrared radiation and a permanent localized solid attribute at a predetermined location in the non imaging seam region, the attribute adapted to reduce by at least about 50 percent direct reflection by the seam itself of a beam of monochromatic infrared radiation originally directed at the attribute. This belt is used in imaging apparatus and imaging processes.

21 Claims, 7 Drawing Sheets

SEAMED FLEXIBLE ELECTROSTATOGRAPHIC IMAGING BELT HAVING A PERMANENT LOCALIZED SOLID ATTRIBUTE

BACKGROUND OF INVENTION

This invention relates in general to electrostatographic imaging members and more specifically, to seamed electrostatographic imaging members having a permanent localized solid attribute to enable avoidance of imaging on the seam and processes and apparatus for using these imaging members.

Flexible electrostatographic belt imaging members are well known in the art. Typical electrostatographic flexible belt imaging members include, for example, photoreceptors for electrophotographic imaging systems and electroceptors such as ionographic imaging members for electrographic imaging systems. Generally, these belts comprise at least a supporting substrate layer and at least one imaging layer comprising thermoplastic polymeric matrix material. The "imaging layer" as employed herein is defined as the dielectric imaging layer of an electroceptor belt and the photoconductive imaging layer of an electrophotographic belt. The photoconductive imaging layer may comprise a single photoconductive layer or a plurality of layers such as a combination of a charge generating layer and a charge transport layer.

Flexible electrophotographic imaging member belts are usually multilayered photoreceptors that comprise a substrate, an electrically conductive layer, an optional hole blocking layer, an optional adhesive layer, a charge generating layer, and a charge transport layer and, in some embodiments, an anti-curl backing layer. A typical layered photoreceptor having separate charge generating (photogenerating) and charge transport layers is described in U.S. Pat. No. 4,265,990, the entire disclosure thereof being incorporated herein by reference. The charge generating layer is capable of photogenerating holes and injecting the photogenerated holes into the charge transport layer.

The flexible electrostatographic imaging member belt is fabricated from a sheet cut from a web containing thermoplastic polymeric material. The sheets are usually rectangular in shape. All edges may be of the same length or one pair of parallel edges may be longer than the other pair of parallel edges. The sheets are formed into a belt by joining overlapping opposite marginal end regions of the sheet. A seam is typically produced in the overlapping marginal end regions at the point of joining. Joining may be effected by any suitable technique. Typical joining techniques include welding (e.g., ultrasonic), gluing, taping, pressure heat fusing, and the like. Ultrasonic welding is generally the preferred method of joining because it is rapid, clean (no solvents or other fumes) and produces a thin and narrow seam. In addition, ultrasonic welding is favored because it causes generation of heat, only at the contiguous overlapping end marginal regions of the sheet, to maximize melting of one or more layers therein.

In a typical electrophotographic imaging process, a photoreceptor surface is charged to a substantially uniform potential so as to sensitize the surface thereof. The charged portion of the photoreceptor surface is exposed to a light pattern. Exposure of the charged photoreceptor surface selectively dissipates the charges thereon in the irradiated areas. This process forms an electrostatic latent image on the photoreceptor surface. After the electrostatic latent image is formed on the photoreceptor surface, the latent image is developed by bringing a developer material into contact therewith. Generally, the developer material comprises toner particles. The toner particles are attracted to the latent image to form a toner image on the photoreceptor surface. The toner image is then transferred from the photoreceptor surface to a receiving sheet. The toner particles are heated to permanently affix the image to the receiving sheet. After each transfer process, any toner residue remaining on the photoreceptor surface may be cleaned by a suitable cleaning device.

In a system of the foregoing type, a seamed flexible multilayered photoreceptor belt is often used. The seam of the belt is not a desirable location for forming images thereon due to the presence of surface discontinuities along the seam which cause the seam itself to be printed out on the receiving sheet. To prevent printing on the seam of seamed photoreceptor belts, a timing hole is punched through the ground strip which runs along one edge of the belt. The hole is located in the ground strip at a predetermined distance from the seam and from nearest outer edge of the belt. This hole is detected by a dedicated detector as the hole passes a predetermined position along the imaging path of the photoreceptor so that the seam can be tracked to prevent formation of electrostatic latent images on the seam. Unfortunately, the hole in the seam allows debris to pass through it to form undesirable deposits on critical machine components. Moreover, the hole punching operation requires sophisticated equipment for aligning the seam and punching the hole in the belt. Further, the dedicated detector comprises a light source on one side of the belt and a light detector on the other side of the belt as well as a power source and appropriate electrical connections, which adds to the imaging machine manufacturing cost. Thus, there is a need for an improved system to locate the position of the seam without using a dedicated detecting sensor in combination with a hole through the ground strip of the belt.

In copying or printing systems, such as a xerographic copier, laser printer, or ink-jet printer, a common technique for monitoring the quality of prints is to artificially create a "test patch" of a predetermined desired density. The actual density of the printing material (toner or ink) in the test patch can then be optically measured to determine the effectiveness of the printing process in placing this printing material on the print sheet.

In the case of xerographic devices, such as a laser printer, the surface that is typically of most interest in determining the density of printing material thereon is the charge-retentive surface or photoreceptor, on which the electrostatic latent image is formed and subsequently, developed by causing toner particles to adhere to areas thereof that are charged in a particular way. In such a case, the optical device for determining the density of toner on the test patch, which is often referred to as a toner area coverage sensor or "densitometer", is disposed along the path of the photoreceptor, directly downstream of the development of the development unit. There is typically a routine within the operating system of the printer to periodically create test patches of a desired density at predetermined locations on the photoreceptor by deliberately causing the exposure system thereof to charge or discharge as necessary the surface at the location to a predetermined extent.

The test patch is then moved past the developer unit and the toner particles within the developer unit are caused to adhere to the test patch electrostatically. The denser the toner on the test patch, the darker the test patch will appear in optical testing. The developed test patch is moved past a densitometer disposed along the path of the photoreceptor, and the light absorption of the test patch is tested; the more light that is absorbed by the test patch, the denser the toner on the test patch. Xerographic test patches are traditionally printed in the interdocument zones on the photoreceptor. Generally each patch is about an inch square that is printed as a uniform solid half tone or background area. Thus, the traditional method of process controls involves scheduling solid area, uniform halftones or background in a test patch. Some of the high quality printers contain many test patches.

DESCRIPTION OF THE RELATED ART

U.S. Pat. No. 5,574,527 issued to Folkins on Nov. 12, 1996—A method and apparatus are described for sensing multiple process parameters with a single sensor in a printing machine. The sensor senses the photoreceptor belt seam to insure that the latent image is not formed on the belt seam; the toner density is used to control the toner dispenser, photoreceptor charging, developer bias, image exposure and image processing systems; registration marks which are used to control registration and multiple images; presence of copy sheets in a paper transport which is used to indicate timing and paper jams or faults; and copy sheet type which is used to control the fusing process time. In order to measure all these parameters, the sensor is uniquely located in printing parameter sensing relationship to the photoreceptor and along the paper path of the printing machine.

U.S. Pat. No. 4,318,610 Issued to Grace on Mar. 9,1982—An apparatus is disclosed in which toner particle concentration within a developer mixture and charging of the photoconductive surface are controlled. A first test area and a second test area are recorded on the photoconductive surface. Toner particles are deposited on the first test area having a greater density than the toner particles deposited on the second test area. Concentration of toner particles within the developer mixture is controlled in response to the toner particle density of the first test area. Charging of the photoconductive surface is regulated in response to the toner particle density of the second test area. The toner particle concentration within a developer mixture may be controlled using a signal from an infrared densitometer which measures the density of toner particles in the two test patch areas.

U.S. Pat. No. 4,553,033 Issued to Hubble, III et al. on Nov. 12, 1985—An integral, compact infrared reflectance densitometer is disclosed including a substrate supporting an LED, a control photodiode to compensate for component degradation, a background photodiode to compensate for background radiation, and a large area photodiode to provide an electrical signal representative of the amount of toner particles on the photosensitive surface. Also carried on the substrate is a field lens to focus light rays reflected from the photosensitive surface onto the signal photodiode. The substrate is precisely secured to a molded housing having integral collector and collimating lenses. Four extending pins on the housing engage four apertures on the substrate to locate the substrate with respect to the housing and align the LED and field lens carried on the substrate with the collector and collimating lenses of the housing. Also carried on the substrate is an aperture box to permit a portion of the LED light to project through the collimating lens to the photosensitive surface and a portion of the light to be reflected onto the control photodiode to control light output. The light rays reflected from the photosensitive surface are gathered in a collector lens and projected through the field lens to be focused onto the signal photodiode. An L-shaped clip and an appendage with an elongated aperture extend from opposite ends of the housing to position an align the infrared reflectance densitometer in the reproduction machine with respect to the photosensitive surface.

U.S. Pat. No. 4,950,905 issued to Butler, et al. on Aug. 21, 1990—A non-black colored toner DMA sensor arrangement is disclosed which includes a light emitting device for illuminating a toner/surface substrate with light of a wavelength to which colored toners are non-absorbing, and to which the imaging surface is either partially absorbing or transmissive. Light is reflected from the toner predominantly by either scattering or multiple reflections to produce a significant component of diffusely reflected light. A sensor is arranged for detection of the diffusely reflected light, at an angle that does not detect the specularly reflected component of reflected light. An increasing level of diffusely reflected light indicates an increased density of toner coverage per unit area.

U.S. Pat. No. 4,989,985 issued to Hubble, III et al. on Feb. 5, 1991—An infrared densitometer is disclosed which measures the reduction in the specular component of reflectivity as marking particles are progressively deposited on a moving photoconductive belt. Collimated light rays are projected onto the marking particles. The light rays reflected from at least the marking particles are collected and directed onto a photodiode array. The photodiode array generates electrical signals proportional to the total flux and the diffuse component of the total flux of the reflected light rays. Circuitry compares the electrical signals and determines the difference therebetween to generate an electrical signal proportional to the specular component of the total flux of the reflected light rays.

U.S. Pat No. 5,291,245 Issued to Charnitski, et al. on Mar. 1, 1994—An apparatus and method are disclosed for detecting the seam in a photoreceptor belt. A sensor is positioned on one side of the belt in opposed relationship to a light source which can be a lamp dedicated solely to that purpose or light from an imager such as an LED array or a Raster Output Scanner. Illumination from the light source of the end of the array is detected by a sensor when the seam passes therebetween creating a characteristic output signal which is recognized by system software and used to control imager operation to ensure that latent images are not formed across the seam.

U.S. Pat. No. 5,053,822 to Butler, issued Oct. 1, 1991—An electrographic apparatus having a densitometer is disclosed, which achieves improved measuring of marking particle density on a photoreceptor or the like. The measuring detects both specular and diffuse light reflected off of the photoreceptor containing marking particles. A compensation ratio is generated from a high density marking particle patch, and is used to compensate the marking particle density to both changing environmental conditions and differences between individual machines. Thus, a more accurate specular signal is calculated which is an accurate indicator of toner density of mass per unit of area concentration. These concentration measures enable accurate adjustments of the electrographic apparatus color toner development systems.

U.S. Pat. No. 5,119,132 to Butler, issued Jun. 2, 1992—The present invention relates generally to an electrographic apparatus and more specifically to an improved structural arrangement in electrographic apparatus of the type having a densitometer, which arrangement achieves improved measuring of marking particle density on a photoreceptor or the like. Wherein, use of a charge-coupled device (CCD) allows for a pixel-by-pixel recordation of the photo intensity reflected off of the photoreceptor and toner test patch. Therefore, as a result of the increased sensitivity of the toner measuring, it is possible to measure denser patches of toner, both black as well as color. Thus allowing for accurate monitoring of the amount of toner capable of being placed onto a photoreceptor.

U.S. Pat. No. 5,394,223 to Hart et al., issued Feb. 28, 1995—An apparatus is disclosed for positional tracking a moving photoconductive belt and adjusting an imager in an electrophotographic printing machine to correct for alignment errors when forming a composite image. Registration error are sensed by developing an appropriate set of target marks, detecting the target marks, and controlling the position of the imager.

U.S. Pat. No. 5,519,497 to Hubble,III et al., issued May 21, 1996—An infrared densitometer is disclosed which measures the diffuse component of reflectivity as marking particles are progressively deposited on a moving photoconductive belt. Collimated light rays are projected onto a test patch including the marking particles. The light rays reflected from the test patch are collected and directed onto a photodiode array. The photodiode array generates electrical signals proportional to the total flux and a diffuse component of the total flux of the reflected light rays. Circuitry compares the electrical signals and determines the difference to generate an electrical signal proportional to the specular component of the total flux of the reflected light rays. Additional circuitry adds the electrical signals proportional to the total flux and the diffuse component of the total flux of the reflected light rays and compares the result of the summed signal to the specular component to provide a total diffuse signal for controlling developed mass.

U.S. Pat. No. 5,652,946 to Scheuer et al., issued Jul. 29, 1997—A method is disclosed of automatically positioning a test pattern in the interdocument zone of an imaging surface of a printing machine using a sensor with a given field of view. Once the test pattern has been provided in the interdocument zone of the imaging surface, the timing relationship of the test pattern to a plurality of edges of the sensor field of view is determined. The control then responds to the timing relationships to locate the sensor field of view with respect to the test pattern and determine the time period between creating a test pattern and sensing the test pattern.

U.S. Pat. No. 5,708,916 to Mestha, issued Jan. 13, 1998—An electrostatographic printing machine is disclosed having an imaging system for projecting and developing images on an imaging member. A process control loop includes a sensor to measure developed mass per unit area on at least three test patches on the imaging member including high area coverage, low area coverage, and mid tone coverage. A comparator responds to the sensor measurements and to developed mass per unit area step points to provide error signals. A control unit responds to the error signals to adjust projecting, developing, and imaging member subsystems.

U.S. Pat. No. 5,710,958 to Raj, issued Jan. 20, 1998—A method is disclosed for adjusting image quality in a printing machine having a variable density image developed on a photoconductive surface in accordance with an initial set of starting values. The method includes a first layer of detecting a plurality of densities of the variable density image and transmitting a plurality of signals with each signal being indicative of a density; generating new starting values, responsive to the plurality of signals, using a linearized perturbation model; calculating error values, response to the plurality of signals, minimizing the sum of the squares of the error values; testing the error values for convergence on a set of reference values with each reference value indicative of an acceptable density; repeating the detecting, transmitting generating, calculating, and testing steps for a plurality of iterations. If the error values exceed the reference values and the plurality of iterations exceed a prescribed value (non-convergence), it will branch to a second and third layer of controlling the development bias voltage and adjusting the toner concentration. If convergence is not obtained in either the second or third layer, an image quality fault will be issued.

U.S. Pat. No. 5,773,827 to Yazdy et al., issued Jun. 30, 1998—An infrared reflectance densitomer (IRD) sensor is disclosed which utilizes four blocks each of which generates an element of a given equation and a fifth block which generates an output voltage based on the given equation. The IRD sensor eliminates a problem known as hunting.

Thus, there is a continuing need to improve electrostatographic imaging member belts, particularly flexible seamed photoreceptor belts which facilitate precision registration to prevent image formation directly over the seam of a seamed electrostatographic imaging member belt without the use of a timing hole through the ground strip and without the use of a dedicated timing hole detecting device.

SUMMARY OF THE INVENTION

It is, therefore, an object of the present invention to provide a seamed flexible electrostatographic imaging member belt which eliminates the requirement of a timing hole in the ground strip and a sensing device to effect precision belt registration which thereby prevents image formation directly over the seam area.

It is another an object of the present invention to provide a seamed flexible electrostatographic imaging member belt having improved belt registration effectiveness.

It is yet another object of the present invention to provide a seamed flexible electrostatographic imaging member belt which promotes precise belt registration and reduces manufacturing costs.

It is still another object of the present invention to provide a seamed flexible electrostatographic imaging member belt which improves imaging functions.

The foregoing objects and others are accomplished in accordance with one aspect of the present invention, by providing a flexible electrostatographic imaging belt having two parallel sides and a narrow non imaging seam region extending substantially from one of the sides to the other side, the non-imaging seam region having a leading edge, a trailing edge, and a seam within the non imaging seam region, the leading and trailing edges being perpendicular to the two parallel sides of the imaging belt, the belt comprising a substrate layer, a reflective electrically conductive layer, at least one imaging layer, an imaging region extending around the belt from the leading edge of the seam region to the trailing edge, the imaging region adapted to reflect monochromatic infrared radiation, and a permanent localized solid attribute at a predetermined location in the non imaging seam region, the attribute occupying an area of from about 10 square millimeters to an area occupying the entire non imaging seam region, the attribute adapted to reduce by at least about 50 percent direct reflection by the seam of a beam of monochromatic infrared radiation originally directed at the attribute.

This belt is used in imaging apparatus and imaging processes.

Although this invention deals with seamed electrostatographic imaging member belts, for reasons of convenience and simplification, the discussion hereafter will focus only on flexible seamed photoreceptor belts.

BRIEF DESCRIPTION OF DRAWINGS

A more complete understanding of the present invention can be obtained by reference to the accompanying drawings wherein.

DETAILED DESCRIPTION OF THE DRAWINGS

Figure 1:
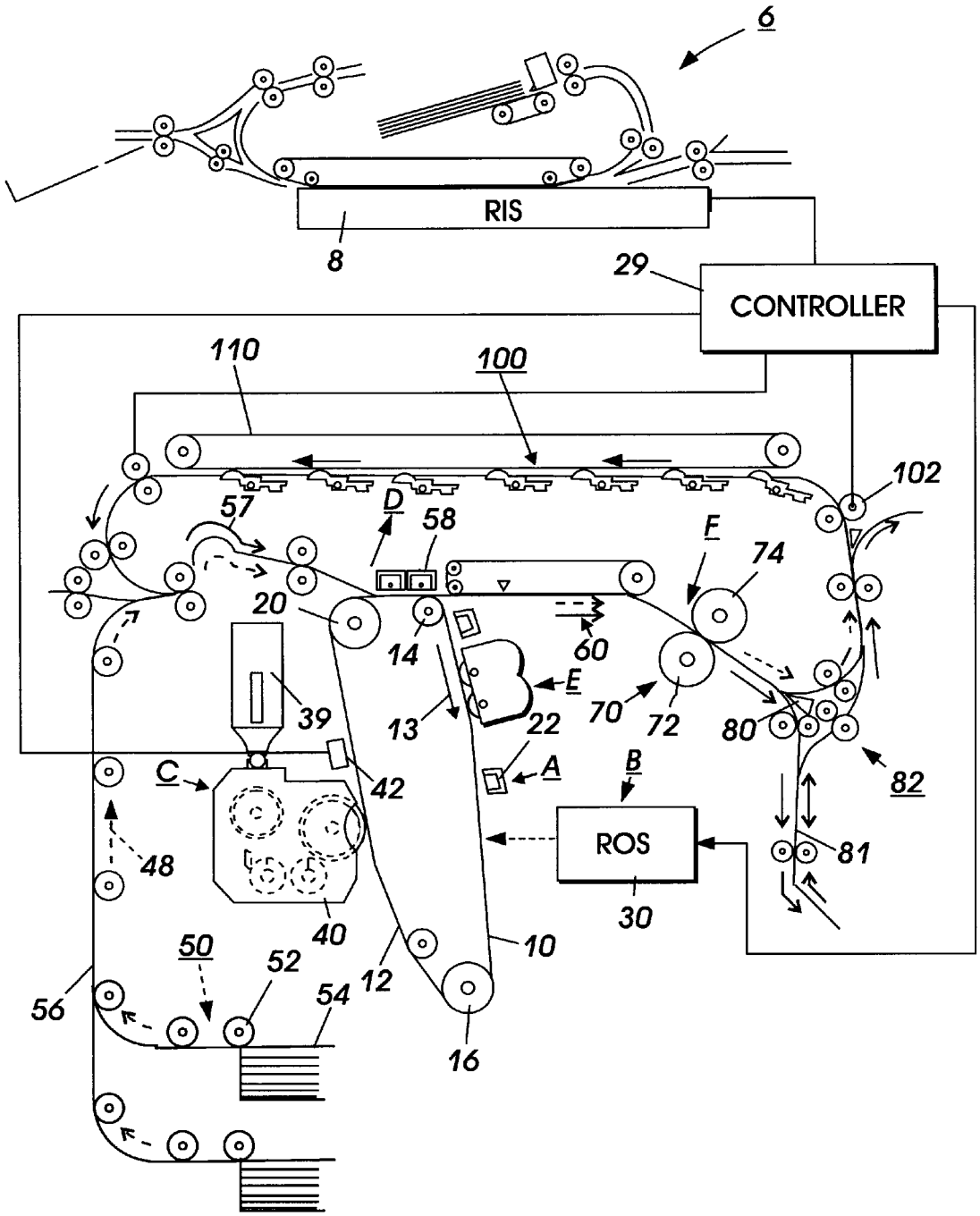
FIG. 1 is a schematic elevational view of a typical electrophotographic printing machine utilizing a toner maintenance system therein.

For a general understanding of the features of the present invention, reference is made to the drawings. In the drawings, like reference numerals have been used throughout to identify identical elements.

FIG. 1 schematically depicts a typical electrophotographic printing machine utilizing a photoreceptor belt and a toner area coverage device. It will become evident from the following discussion that physical modification of the photoreceptor belt seam region by forming a specific permanent localized solid attribute in a predetermined location can effectively aid in the locating of belt seams. Although seam location can be identified with the aid of the specific seam detector assembly combination illustrated in FIG. 1, the present invention may be employed in a wide variety of devices and is not specifically limited in its application to the particular embodiments depicted herein.

Referring to FIG. 1, an original document is positioned in a document handler 6 on a raster input scanner (RIS) indicated generally by reference numeral 8. The RIS contains document illumination lamps, optics, a mechanical scanning drive and a charge coupled device (CCD) array (not shown). The RIS captures the entire original document and converts it to a series of raster scan lines. This information is transmitted to an electronic subsystem (ESS) which controls a raster output scanner (ROS) described below.

FIG. 1 also schematically illustrates an electrophotographic printing machine which generally employs a photoreceptor belt 10 having an outer imaging surface 12. Preferably, the photoreceptor belt 10 comprises at least one imaging layer containing a photoconductive material coated on a reflective electrically conductive layer, which, in turn, is coated on a substrate layer backed with an anti-curl backing layer. Belt 10 has an outer imaging surface 12. Belt 10 moves in the direction of arrow 13 to advance successive portions of the belt imaging region sequentially through the various processing stations disposed about the path of belt movement. Belt 10 is entrained about stripping roller 14, tensioning roller 16 and drive roller 20. As the drive roller 20 rotates, it advances belt 10 in the direction of arrow 13.

Initially, a portion of the outer imaging surface 12 of the belt 10 passes through charging station A. At charging station A, a corona generating device indicated generally by the reference numeral 22 charges the outer imaging surface 12 of photoreceptor belt 10 to a relatively high, substantially uniform potential.

A controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30 at exposure station B. Preferably, controller 29 is a self-contained, dedicated minicomputer. The image signals transmitted to controller 29 may originate from a RIS as described above or from a computer, thereby enabling the electrophotographic printing machine to serve as a remotely located printer for one or more computers. Alternatively, the printer may serve as a dedicated printer for a high-speed computer. The signals from controller 29, corresponding to the continuous tone image desired to be reproduced by the printing machine, are transmitted to ROS 30. ROS 30 includes a laser with rotating polygon mirror blocks. The ROS illuminates the charged portion of the imaging region of photoreceptor belt 10 at a resolution of about 300 or more pixels per inch. The ROS 30 will expose the imaging region of the outer imaging surface 12 of photoreceptor belt 10 to form an electrostatic latent image thereon corresponding to the continuous tone image received from controller 29; alternatively, ROS 30 may employ a linear array of light emitting diodes (LEDs) arranged to illuminate the charged portion of the imaging region of photoconductive belt 10 on a raster-by-raster basis. RIS, CCD, ESS, ROS and LED devices are conventional and well known in the imaging art.

After the electrostatic latent image has been recorded on the imaging region of the outer imaging surface 12, belt 10 advances the latent image in the direction indicated by arrow 13 to a development station C where toner particles, from liquid or dry developer, are electrostatically attracted to the latent image using conventional development techniques. The latent image attracts toner particles from the developer to form a toner particle image thereon. As successive electrostatic latent images are developed, toner particles are depleted from the developer material. A toner particle dispenser, indicated generally by the reference numeral 39, on signal from controller 29, dispenses toner particles into developer housing 40 of development station C based on signals from a toner maintenance sensor (not shown). Development station C can be any suitable development system such as hybrid jumping development or a magnetic brush development system.

A conventional toner area coverage (TAC Sensor) 42 is positioned over outer imaging surface 12 to determine the toner area coverage. TAC Sensor 42 is connected to controller 29. This TAC sensor 42 emits a monochromatic infrared beam directed toward the imaging surface 12 of photoreceptor belt 10 and also simultaneously detects the intensity of the corresponding reflected infrared radiation directly from the belt during electrophotographic imaging and photoreceptor belt image cycling processes. Controller 29 coordinates the operation of the various components. In particular, controller 29 responds to TAC sensor 42 and provides suitable actuator control signals to corona generating device 58, ROS 30, and development station C. The actuator control signals include state variables such as charge voltage, developer bias voltage, exposure intensity and toner concentration. The controller 29 may include an expert system including various logic routines to analyze sensed parameters in a systematic manner and reach conclusions on the state of the machine. Changes in output generated by the controller 29, in a preferred embodiment, are measured by TAC sensor 42. TAC sensor 42, which is located after development station C, measures the developed toner mass for difference area coverage patches recorded on the imaging surface 12. The manner of operation of the TAC sensor 42, shown in FIG. 1, is described in U.S. Pat. No. 4,553,003 the entire disclosure thereof being incorporated herein by reference. TAC sensor 42, is an infrared reflectance type densitometer that measures the density of toner particles developed on the photoconductive imaging surface 12. Infrared densitometers and controller systems for densitometers are known and described, for example in U.S. Pat. No. 5,574,527, U.S. Pat. No. 4,318,610, U.S. Pat. No. 4,989,985, U.S. Pat. No. 5,291,245, U.S. Pat. No. 5,710,958, copending U.S. patent application Ser. No. 09/035,137, now U.S. Pat. No. 5,903,796, entitled "P/R PROCESS CONTROL PATCH UNIFORMITY ANALYZER", filed in the name of Roger W. Budnik et al., U.S. patent application Ser. No. 09/033,621, entitled "NON-UNIFORM DEVELOPMENT INDICATOR", filed in the name of Roger W. Budnik et al., and U.S. patent application Ser. No. 09/035,080, entitled "XEROGRAPHIC XERCISER", filed in the name of Roger E. Budnik et al. The entire disclosures of these patents and applications are incorporated herein by reference.

The imaging surface 12 of photoreceptor belt 10 is sufficiently large circumferentially to carry at least two spaced apart document imaging regions. Images formed on each document imaging region correspond to an original hard copy or electronic document. Generally, a temporary test patch is formed in the interdocument space between one imaging region and the adjacent imaging region and in that portion of the imaging surface 12 sensed by the TAC sensor 42 to provide the necessary signals for control. The temporary test patch can be a composite patch which, in a preferred embodiment, measures 15 millimeters, in the process direction, and 45 millimeters, in the cross process direction to provides various halftone level patches such as an 87.5 percent patch, a 50 percent halftone patch and a 12.5 percent halftone patch.

Before the TAC sensor 42 can provide a meaningful response to the relative reflectance of patch, the TAC sensor 42 is calibrated by measuring the light reflected from a bare or clean area portion imaging surface 12. For calibration purposes, current to a light emitting diode (LED) internal to the TAC sensor 42 is increased until the voltage generated by the TAC sensor 42 in response to light reflected from the bare or clean area of imaging surface 12 is between 3 and 5 volts.

It should be understood that the term TAC sensor or "densitometer" is intended to apply to any suitable device for determining the density of print material on a surface, such as an infrared densitometer or any other such device which makes a physical measurement from which the density of print material may be determined.

Referring further to FIG. 1, after the electrostatic latent image is developed, the toner particle image present on belt 10 advances to transfer station D. A print sheet 48 is advanced to the transfer station D by a sheet feeding apparatus 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of into registration transport 57 past image transfer station D to receive an image from photoreceptor belt 10 in a timed sequence so that the toner particle image formed thereon contacts the advancing sheet 48 at transfer station D. Transfer station D includes a corona generating device 58 which sprays ions onto the back side of sheet 48. This attracts the toner particle image from imaging surface 12 of the photoreceptor belt 10 to sheet 48. After transfer, sheet 48 continues to move in the direction of arrow 60 by way of belt transport which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the particle image on the copy sheet contacting fuser roller 72.

The sheet then passes through fuser 70 where the image is permanently fixed or fused to the sheet. After passing through fuser 70, a gate 80 either allows the sheet to move directly via output 81 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to exit path 81. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transport 110, for recirculation back through transfer station D and fuser 70 for receiving and permanently fixing the side two image to the backside of the duplex sheet, before it exits via exit path 81. After the print sheet is separated from outer imaging surface 12 of belt 10, the residual toner/developer and paper fiber particles adhering to outer imaging surface 12 are removed therefrom at cleaning station E. Cleaning station E includes a rotatably mounted fibrous brush in contact with outer imaging surface 12 to disturb and remove paper fibers and a cleaning blade to remove any untransferred toner particles. The blade may be configured in either a wiper or doctor position depending on the application. Subsequent to cleaning, a discharge lamp (not shown) floods outer imaging surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions described above including toner dispensing. The controller 29 provides a comparison count of the copy sheets, the number of documents being recirculated, the number of copy sheets selected by the operator, time delays, jam corrections, etc. Control of all of the exemplary systems heretofore described may be accomplished by conventional control switch inputs from the printing machine consoles selected by the operator. Conventional sheet path sensors or switches may be utilized to keep track of the position of the document and the copy sheets.

The foregoing description illustrates the general operation of an electrophotographic printing machine utilizing a flexible photoreceptor belt into which the features of embodiments of the present invention can be incorporated.

Figure 2:
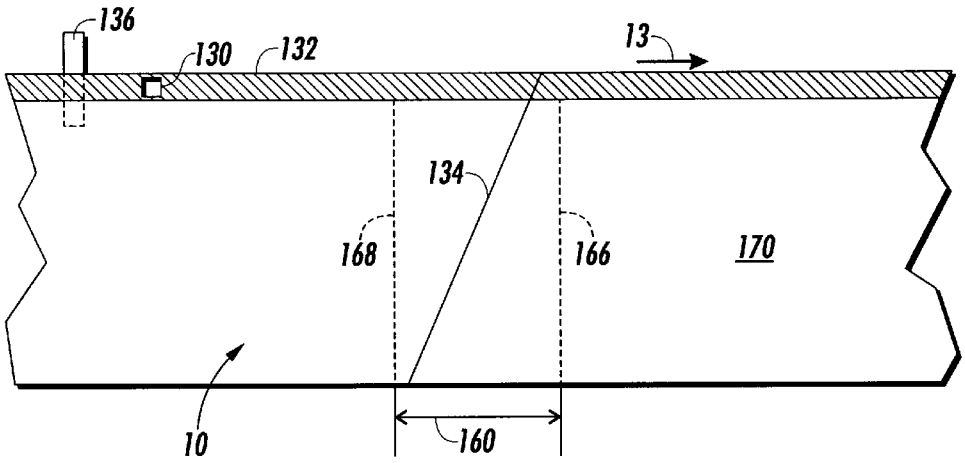
FIG. 2 Prior Art
FIG. 2 is a schematic plan view of a flexible seamed photoreceptor belt illustrating a conventional timing hole in the ground strip of the belt to facilitate registration with a detector to accurately sense the location of the belt seam and to positively identify the corresponding non imaging seam region of the belt.

Turning now to FIG. 2, a plan view is shown of a typical conventional photoreceptor belt arrangement. A timing hole 130 in belt 10 is usually punched through ground strip 132 at a predetermined location relative to the seam 134 of the belt 10. A dedicated detector 136 located below hole 130 is then used to detect and register the passage of light through hole 130. Light is emitted by a conventional source (not shown) located above hole 130 and opposite detector 136. Image timing is keyed from this detection/registration location of the detector 136 and light source as the belt hole 130 passes by moving in the direction indicated by arrow 13 during electrophotographic image cycling. This arrangement is reliable but requires the presence of a hole 130 in the belt 10 as well as the addition of a dedicated detector 136, a dedicated light source, and associated controls therefor.

Figure 3:
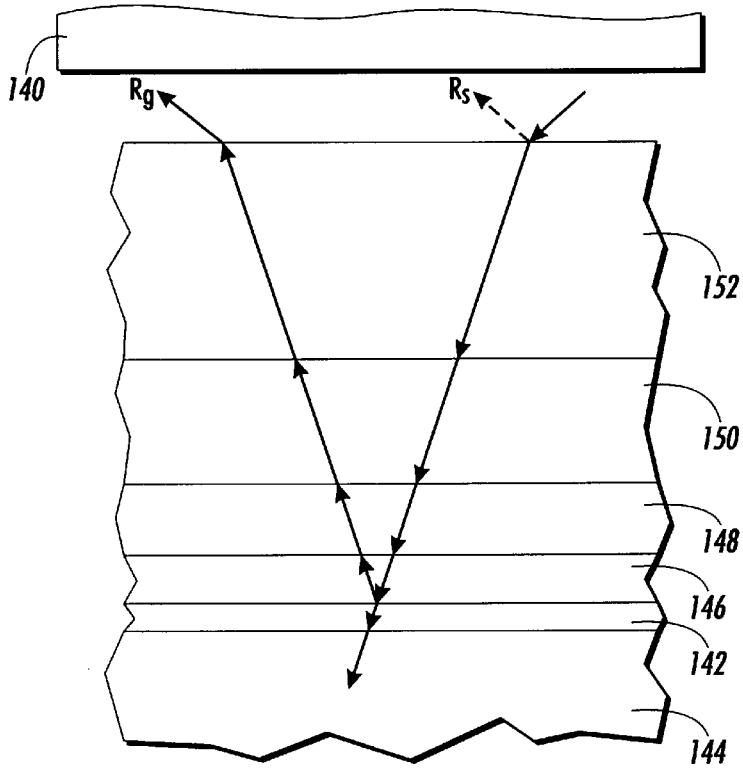
FIG. 3 Prior Art
FIG. 3 is a partial schematic cross-sectional view of the photoreceptor belt of FIG. 2, having conventional coating layers, which illustrates the interaction of a light incident beam generated from an illumination source and the reflection detection by an area coverage sensing device.

In many current black and white as well as color commercial printing machines, a sensor is used to determine the toner area coverage (TAC Sensor) over the photoreceptor belt surface. As illustrated in FIG. 3, the TAC sensor 140 emits a monochromatic infrared beam directed toward the imaging surface of photoreceptor belt 10 and also simultaneously detects the intensity of the corresponding directly reflected infrared radiation from the belt 10 during electrophotographic imaging and photoreceptor belt cycling processes. The TAC sensor 140 emits the original incident infrared beam and also detects the intensity of the directly reflected infrared radiation. The original incident infrared beam from TAC sensor 140 is angled very slightly from the surface of the photoreceptor belt to facilitate capture and detection by the detector component, which is also slightly angled, of the directly reflected radiation energy by TAC sensor 140. The detector component of TAC sensor 140 generates an analog voltage output signal according to the received intensity of the directly reflected infrared radiation. In other words, the TAC sensor performs the dual functions of emitting the original incident infrared beam as well as monitoring and detecting the intensity of the corresponding directly reflected radiation from the photoreceptor belt. A typical TAC sensor is described in U.S. Pat. No. 4,553,033, the entire disclosure thereof being incorporated herein by reference. Thus, for example, the TAC sensor may comprise a substrate supporting an LED, a control photodiode to compensate for component degradation, a background photodiode to eliminate background radiation, a signal photodiode (detector) to provide an electrical signal representative of the amount of toner particles on the photosensitive surface, and an integrated circuit chip to perform LED drive and signal processing functions. A field lens may be used to focus directly reflected light rays onto the signal photodiode. These components may be secured in a single molded housing or in separate housings. Whether secured in a single or multiple housings, the combination of light source and light detector are, for the sake of convenience, referred to herein as a TAC sensor. Since virtually all current commercial photoreceptors are photosensitive only in the visible and near infrared regions of the electromagnetic radiation spectrum, it is essential that the original incident infrared beam emitted by the infrared emitting light source component of the sensor has a monochromatic wavelength which is not photo absorbed by the imaging region as well as the non imaging seam region (other than the seam itself) of the photoreceptor belt in order to achieve effective direct reflection detection without adversely affecting image quality. In other words, the photoconductive material employed in the seamed photoreceptor belt of this invention should be substantially insensitive to the wavelength selected for use by the TAC sensor and remains substantially electrically insulating during exposure to the infrared beam. Although ultraviolet (UV) radiation is also outside the range of photoreceptor sensitivity, it is normally undesirable because exposure of the photoconductive layers in the photoreceptor belt to UV can permanently damage the ability of the photoreceptor to properly perform its electrophotographic functions. Thus, UV radiation is unsuitable for emission use by the sensors utilized in the process of this invention. Any suitable monochromatic infrared radiation having a wavelength to which the photoconductive layers of the photoreceptor belt of this invention is insensitive may be utilized for determining belt surface toner area coverage. A typical monochromatic infrared beam emitted from the sensors utilized in the process of this invention has a diameter between about 1 mm and about 6 millimeter and a wavelength greater than about 800 nm. If desired, the wavelength can be as high as the beginning of the microwave and radio wave region of the electromagnetic radiation spectrum. An emitted (original) infrared beam diameter in the range of from about 1 millimeters to about 6 millimeters provides satisfactory results. Preferably, the diameter of the infrared beam is between about 3 millimeters and about 4 millimeters and has a wavelength of between about 850 nm and about 950 nm.

Also shown in FIG. 3 is a partial schematic cross-sectional view of the seamed photoreceptor belt of FIG. 2 having conventional coating layers. FIG. 3 illustrates the interaction between a photoreceptor and TAC sensor 140. In the demonstrated invention embodiments, the light source component of TAC sensor 140 emits an original monochromatic infrared (e.g., 880 nm) incident light beam that is slightly angled from the imaging surface of the photoreceptor belt to form, for example, about 19 degrees with the imaging surface and the detector component of the TAC sensor 140 detects the directly reflected radiant energy from the photoreceptor surface. The directly reflected radiant energy is therefore slightly angled from the imaging surface of the photoreceptor belt, making about 19 degrees with the imaging surface. The specific angle utilized for incident and reflected radiant energy depends to a great extent on machine geometry. Since the TAC sensor is preferably supported in a stationary location above and near the photoreceptor belt surface, a small angle can be selected for close positioning of the radiant energy source component and the detector component in the TAC sensor 140. Although, as described above, the radiant energy source component in the TAC sensor 140 and the detector component in the TAC sensor can be in separate units, it can be more difficult to initially align and thereafter maintain alignment of separate units. Moreover, an integrated unit is less costly and can occupy less space than separated units. In other words, the TAC sensor 140 preferably contains both the light source and the light detector in one integral unit. The TAC sensor 140 is supported by any suitable device, such as the frame (not shown) of an imaging machine, in a fixed position above and near the mid section of the belt to project an infrared beam onto the imaging surface of the belt and to detect the direct reflection of the infrared beam when the beam strikes toner test patches during image cycling of belt 10. The photoreceptor 10 is a flexible seamed belt and includes, for purposes of illustration, a reflective electrically conductive ground plane layer 142 of a metal, such as titanium, formed on a substrate layer 144, such as polyethylene terephthalate. Conductive layer 142 is coated, with a hole blocking layer 146, such as an organopolysiloxane. Formed on top of blocking layer 146 is an adhesive interface layer 148, e.g. polyester adhesive, which is coated with a photoconductive charge generation layer 150. A charge transport layer 152 overlies charge generation layer 150. An 880 nm infrared incident beam of light is partially reflected from the photoreceptor imaging surface as beam Rs. Beam Rs is a weak reflection. The remainder of the incident beam of light enters the charge transport layer 152 and is bent, due to the refractive index difference between air (having a value of 1.0) and layer 152 (having a value of 1.57). Since the refractive indexes of all the interfacing layers 146, 148, 150 and 152 are about the same, no significant internal refraction is normally encountered and the light, therefore, travels in a straight line through these layers. Although the light energy, after passing through the photoreceptor layers and eventually reaching the thin reflective electrically conductive layer 142, is partially transmitted through conductive layer 142, nevertheless, a greater fraction is reflected back to layer 152 and exits to the air as beam Rg. The emerging light energy Rg from the photoreceptor 10 is a strong reflection. Both the Rg and Rs reflections are captured by the detector component of TAC sensor 140 and are read out to the controller as voltage output signals.

In the typical photoreceptor belt material package shown in FIG. 3, the thickness of the substrate layer 144 depends on numerous factors, including mechanical strength and economical considerations, and thus, this layer for a flexible belt may, for example, have a thickness of at least about 50 micrometers, or of maximum thickness of less than about 150 micrometers, provided there are no adverse effects on the final electrophotographic imaging device. The reflective conductive layer 142 may vary in thickness over substantially wide ranges depending on the optical transparency and flexibility desired for the electrophotographic imaging member. Accordingly, the thickness of the reflective electrically conductive layer is typically between about 20 angstrom units and about 750 angstrom units, and more preferably between about 50 Angstrom units and about 200 angstrom units for an optimum combination of electrical conductivity, flexibility and light transmission. The conductive 142 layer may be an electrically conductive metal layer which may be formed, for example, on the substrate by any suitable coating technique, such as a vacuum depositing or sputtering technique. Typical metals include aluminum, zirconium, niobium, tantalum, vanadium, hafnium, titanium, nickel, stainless steel, chromium, tungsten, molybdenum, and the like. Where the entire substrate is an electrically conductive metal, the outer surface thereof can perform the function of an electrically conductive layer and a separate electrical conductive layer may be omitted. Upon exposure to the ambient atmospheric environment, the electrically conductive metal ground plane reacts with the atmospheric oxygen and spontaneously forms a thin metal oxide layer on its surface.

After formation of an electrically conductive surface, a hole blocking layer 146 may be applied thereto for photoreceptors employing negative surface charging. However, an electron blocking layer is generally used for a positively charged photoreceptor to allow migration of holes from the imaging layer surface of the photoreceptor through the electron blocking layer toward the conductive layer during electrophotographic imaging processes. Various charge blocking layers capable of forming an electronic barrier to charges between the adjacent photoconductive layer and the underlying conductive layer are utilized in the prior art. The charge blocking layer may comprise nitrogen containing organosilanes, nitrogen containing organotitanium or organozirconium compounds, or a mixture of these materials, as disclosed for example, in U.S. Pat. No. 4,291,110, 4,338,387, 4,286,033 and 4,291,110, the entire disclosures of these patents being incorporated herein by reference.

An optional adhesive layer 148 may be applied to the charge blocking layer of the prior art. Any suitable adhesive layer may be utilized. One well known adhesive layer comprises a polyester resin available as MOR-ESTER 49,000 from Morton International Inc. The MOR-ESTER 49,000 is a linear saturated copolyester reaction product of four diacids and ethylene glycol having a weight average molecular weight of about 70,000. Other examples of adhesive layers include copolyester resins such as, Vitel PE-100, Vitel PE-200, Vitel PE-200D, and Vitel PE-222, all available from Goodyear Tire and Rubber Co. Any adhesive layer employed should be continuous and preferably has a dry thickness between about 0.02 micrometer and about 0.09 micrometer and, more preferably, between about 0.04 micrometer and about 0.07 micrometer. Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be utilized to mix and thereafter apply the adhesive layer coating mixture of this invention to the charge blocking layer.

Any suitable photogenerating layer 150 may be applied to the blocking layer 146 or adhesive layer 148, if an adhesive layer is employed. The photogenerating layer 150 may thereafter be overcoated with a contiguous charge transport layer 152. Examples of photogenerating layer materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine described in U.S. Pat. No. 3,357,989, metal phthalocyanines such as vanadyl phthalocyanine and copper phthalocyanine, quinacridones available from E. I. duPont de Nemours & Co. under the tradename Monastral Red, Monastral violet and Monastral Red Y, Vat Orange 1 and Vat Orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multi-photogenerating layer compositions may be utilized where a photoconductive layer enhances or reduces the properties of the photogenerating layer. Examples of this type of configuration are described in U.S. Pat. No. 4,415,639, the entire disclosure of thereof being incorporated herein by reference. Other suitable photogenerating materials known in the art may also be utilized, if desired. Any suitable charge generating binder layer comprising photoconductive particles dispersed in a film forming binder may be utilized. Photoconductive particles for charge generating binder layer such vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially sensitive to white light. Vanadyl phthalocyanine, metal free phthalocyanine and tellurium alloys are preferred because these materials provide the additional benefit of being sensitive to infrared light. The photogenerating materials selected should be sensitive to activating radiation having a wavelength between about 600 and about 800 nm during the imagewise radiation exposure step in a electrophotographic imaging process to form an electrostatic latent image.

Any suitable inactive resin materials may be employed in the photogenerating binder layer including those described, for example, in U.S. Pat. No. 3,121,006, the entire disclosure thereof being incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like. These polymers may be block, random or alternating copolymers.

The photogenerating composition or pigment can be present in the resinous binder composition in various amounts. Generally, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition.

The photogenerating layer containing photoconductive compositions and/or pigments and the resinous binder material generally has a thickness of between about 0.1 micrometer and about 5 micrometers, and preferably has a thickness of between about 0.3 micrometer and about 3 micrometers. The photogenerating layer thickness is related to binder content. Higher binder content compositions generally require thicker layers for photogeneration. Thicknesses outside these ranges can be selected providing the objectives of the present invention are achieved.

The active charge transport layer 152 may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer 152 not only serves to transport holes or electrons, but also protects the photoconductive or photogenerating layer 150 from abrasion or chemical attack and therefor extends the operating life of the photoreceptor imaging member. The charge transport layer 152 should exhibit negligible, if any, discharge when exposed to a wavelength of light useful in xerography, e.g. about 4000 angstroms to about 9000 angstroms. Therefore, the charge transport layer is substantially transparent to radiation in a region in which the photoconductor is to be used. Thus, the active charge transport layer is a substantially non-photoconductive material which supports the injection of photogenerated holes or electrons from the charge generation layer. The active transport layer is normally transparent when exposure is effected through the active layer to ensure that most of the incident radiation is utilized by the underlying charge carrier generator layer for efficient photogeneration. The charge transport layer in conjunction with the generation layer in the instant invention is a material which is an insulator to the extent that an electrostatic charge placed on the transport layer is not conducted in the absence of activating illumination.

The active charge transport layer 152 may comprise any suitable activating compound useful as an additive dispersed in electrically inactive polymeric materials making these materials electrically active. These compounds may be added to polymeric materials which are incapable of supporting the injection of photogenerated holes or electrons from the generation material and incapable of allowing the transport of these holes or electrons therethrough. This will convert the electrically inactive polymeric material to a material capable of supporting the injection of photogenerated holes or electrons from the generation material and capable of allowing the transport of these holes or electrons through the active layer in order to discharge the surface charge on the active layer.

The charge transport layer forming mixture preferably comprises an aromatic amine compound. An especially preferred charge transport layer employed in one of the two electrically operative layers in the multi-layer photoconductor of this invention comprises from about 35 percent to about 45 percent by weight of at least one charge transporting aromatic amine compound, and about 65 percent to about 55 percent by weight of a polymeric film forming resin in which the aromatic amine is soluble. The substituents should be free from electron withdrawing groups such as $NO_2$ groups, CN groups, and the like. Typical aromatic amine compounds include, for example, triphenylmethane, bis(4-diethylamine-2-methylphenyl)phenylmethane; 4,4'-bis(diethylamino)-2,2'-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N, N'-diphenyl-N, N'-bis(3-methylphenyl)-(1,1'-biphenyl)-4,4'-diamine, and the like dispersed in an inactive resin binder.

Any suitable inactive resin binder soluble in methylene chloride, chlorobenzene or other suitable solvent may be employed in the process of this invention. Typical inactive resin binders include polycarbonate resin, polyvinylcarbazole, polyester, polyarylate, polyacrylate, polyether, polysulfone, and the like.

Examples of photosensitive members having at least two electrically operative layers, including a charge generator layer and diamine containing transport layer, are disclosed in U.S. Pat. Nos. 4,265,990, 4,233,384, 4,306,008, 4,299,897 and 4,439,507. The disclosures of these patents are incorporated herein in their entirety.

Any suitable and conventional techniques may be utilized to mix and thereafter apply the charge transport layer coating mixture to the charge generating layer. Typical application techniques include extruding spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers and about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to about 200:1 and, in some instances, as great as 400:1.

Other layers such as a conventional ground strip layer (e.g. see 132 in FIG. 2) comprising, for example, conductive particles dispersed in a film forming binder may be applied to one edge of the photoreceptor in contact with the conductive layer 142, charge blocking layer 146, adhesive layer 148 or charge generating layer 150. The ground strip layer 132 may have a thickness from about 7 micrometers to about 42 micrometers, and preferably from about 14 micrometers to about 23 micrometers.

Optionally, an anti-curl back coating may be applied to the side of the substrate layer opposite the side bearing the electrically active coating layers in order to provide flatness. The anti-curl back coating layer may comprise organic polymers or inorganic polymers that are electrically insulating or slightly semi-conductive.

A seamed photoreceptor belt normally has a constant reflectivity along the entire belt length in the imaging region and non imaging seam region, except that at the seam 134 of the belt 10 (see FIG. 2) there is a variation in reflectance due to the seam splash of the ultrasonic weld that joins the two opposite ends of the photoreceptor to form the belt. Any ground strip used along one of the sides of the belt is not part of the imaging region nor a part of the non imaging seam region and such ground strip has a much lower reflectivity than the imaging region and non imaging seam region. Thus, the non imaging seam region extends "substantially" from one of the sides of the belt to the other side. More specifically, the "substantially" is intended to encompass the embodiment where the non imaging seam region extends from one of the sides of the belt to the other side when the belt is free of a ground strip and the embodiment where the non imaging seam region extends from one of the sides of the belt to the inner edge of any ground strip running along a side of the belt. The ground strip has a constant low reflectivity along its entire length, except at the point where the seam crosses the ground strip. If the TAC sensor is used to measure the reflectance of the belt, a variance in voltage signal output due to direct reflectance reduction will be detected at the seam 134. This voltage variance can be used to locate and track the belt seam 134 so as to prevent imaging and development in the non imaging seam region 160 as shown in FIG. 2. The narrow seam region 160 encompasses the seam 134 and defines a zone around the seam 134 in which no images are formed during the electrophotographic imaging process. This narrow non imaging seam region 160 extends from one of the two parallel sides of belt 10 to the other side; the seam region 160 has a leading edge 166 and a parallel trailing edge 168 and contains seam 134 within the non imaging seam region 160. Leading edge 166 and a parallel trailing edge 168 are perpendicular to the two parallel sides of belt 10. The seam 134 is shown in FIG. 2 as a skewed or slanted seam, but it may have any other suitable shape such as straight seam running perpendicular to the two parallel sides of belt 10, a wavy seam, a jagged seam, a puzzle cut seam, and the like. However, for all of these seam embodiments, the seam is in the non imaging seam region. The formation of toner images on a seam adversely affects the quality of the final images due to the effect of physical discontinuity at the seam weld. An imaging region 170 extends from the leading edge 166 the trailing edge 168 of the non imaging seam region and defines the region in which electrostatographic images are formed. Although a conventional TAC sensor already present in the machine, with no additional hardware, could be used to track an ordinary seam, this seam detecting technique encounters a moderately weak signal which is found to be comparable to false signals generated by randomly formed scratches or other marks unintentionally formed on the photoreceptor belt during normal belt handling prior to or during imaging. Thus, this approach interferes with and adversely affects consistent, reliably positive seam identification and registration with the aid of a TAC sensor.

Figure 4:
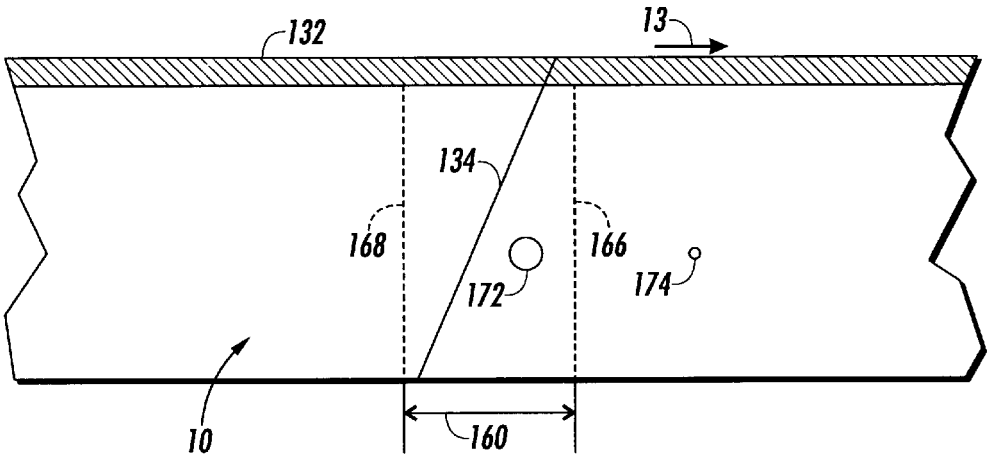
FIG. 4 is a partial schematic plan view of a seamed photoreceptor belt, similar to that of FIG. 2 but with an embossed localized solid attribute in the leading edge side of the non imaging seam region, for suppressing direct light reflection and for facilitating accurate image registration.

To resolve this problem, the present invention focuses on the creation of a specific permanent localized solid attribute 172 on the photoreceptor belt 10 as shown in FIG. 4. The localized solid attribute 172, is formed inside the non imaging seam region 160, overlying or adjacent to the seam 134 in a predetermined location directly beneath the scanning path of the infrared beam 174 emitted from a TAC sensor such as the TAC sensor 140 shown in FIG. 3. The TAC sensor 140 is supported by any suitable device, such as the frame (not shown) of an imaging machine, in a fixed position, e.g., about 10 millimeters above and near the mid section of the belt 10 to project the infrared beam 174 onto the imaging surface of the belt 10 and to detect the suppressed direct reflection of the infrared beam when the beam strikes attribute 172 in a non imaging seam region 160 during image cycling of belt 10. In a typical non imaging seam region 160, the width is about two inches (5.08 cm) and the measured dimension from the midpoint or center of the welded seam 134 to either side of the seam is about 2.54 cm (i.e., leading edge 166 and trailing edge 168). The welded seam 134 illustrated in FIG. 4 is a skewed seam. However any other suitable seam shape may be utilized in place of the skewed seam. Typical seam shapes include, for example, straight seams perpendicular to the parallel sides of the belt, wavy seams, sawtooth seams, puzzle cut seams and the like. All of these seams are located within the non imaging seam region. The localized solid attribute 172 may be created on either side of the seam 134, directly on the seam, or partly on the seam and partly on at least one side of the seam. Preferably, localized solid attribute 172 has an area greater than the cross sectional area of the infrared reading incident beam to enhance solid attribute detection so that the attribute totally encompasses the cross section of the infrared beam when they meet during image cycling. Typically the localized solid attribute 172 occupies an area between about 10 square millimeters and about the entire non imaging seam region 160. It is preferred that the solid attribute occupies an area between about 20 square millimeters and about 37 square millimeters. The localized solid attribute 172 should have a shape which ensures that it at least momentarily encompasses the entire cross section of the infrared beam 174 as the beam crosses over the attribute. To yield best results, it is also preferred that the attribute be located at the leading edge 166 side of the non imaging seam region 160. The maximum area occupied by a localized solid attribute depends on the shape of the attribute and the breadth of the selected non imaging seam region 160. For example, in an imaging belt having a typical one inch or 2.54 centimeters wide non imaging area on each side of a straight seam (oriented perpendicular to the parallel sides of the belt), the largest circular solid attribute that will fit within the borders of the non imaging seam region will occupy an area of about 2,027 square millimeters [i.e. $\Pi$ (25.4 millimeters)$^2$]. In contrast, an attribute having a rectangular shape can fill the entire non imaging seam region 160. The area of a localized solid attribute 172 is preferably greater than the cross sectional area of the incident infrared beam 174 and preferably is between about 20 and 37 square millimeters. For optimum performance, the localized solid attribute 172 is created on the leading edge side of the seam in the non imaging seam region 160. Satisfactory reflection suppression may be achieved with an infrared beam (emitted by the TAC) having a round cross-section and a diameter between about 1 millimeter and about 6 millimeters. Preferably, the beam diameter is between about 3 millimeters and 4 millimeters.

Since the imaging surface of photoreceptor belt is sufficiently large in circumference to carry at least two spaced apart document imaging regions, an interdocument space is provided between one imaging region and the adjacent imaging region. Images formed on each document imaging region correspond to an original hard copy or electronic document. Although a temporary test patch is usually formed in the interdocument space between one imaging region and the adjacent imaging region and in that portion of the imaging surface sensed by the TAC sensor to provide the necessary signals for control, a permanent localized solid attribute of this invention is located only at a predetermined location in the non imaging seam region of the photoreceptor belt. Unlike a temporary test patch which can fluctuate in location and density from cycle to cycle, a permanent localized solid attribute created in the non imaging seam region of the belt always remains in exactly the same location and suppresses direct reflection of incident infrared radiation in substantially the same way from cycle to cycle for total predictability. The permanent localized solid attribute 172 can be of any suitable shape such as circular, elliptical, rectangular, square, triangular, trapezoidal, star, and the like to mark the seamed photoreceptor belt 10. Preferred attribute embodiments, illustrated in FIGS. 5, 6, 7 and 8 can effectively suppress photoreceptor surface reflection near the seam to yield a stronger voltage output signal than the output triggered by false signals due to scratches or other accidental marks inflicted on the photoreceptor belt surface during belt handling prior or during imaging processes which effects positive identification. For a straight seam extending perpendicular to the sides of a photoreceptor belt, a non imaging seam region containing the seam weld in the middle has a typical width of about 5.28 cm because the seam weld itself, for this example, has a width of 0.2 cm (width of 0.1 cm for the overlapped edges forming the seam and width of 0.1 cm for the seam splash on the outer surface of the belt), therefore the non imaging strip on each side of the seam weld has a width of 2.54 cm. For convenience of description, the expression "seam", as employed herein is intended to refer to the combination of the overlapped edges and the seam splash formed on the outer surface of the belt during the belt fabrication welding process. Permanent localized solid attributes 176, 178, 180, and 182 of FIGS. 5, 6, 7, and 8 , respectively, may be created within the boundaries of the non imaging seam region 160, e.g. only on one side of the seam weld, on the seam weld itself, on the trailing edge side of the seam weld, partly on the seam and partly on one or both sides of the seam, or preferably on the leading edge side of the seam weld, and in the path scanned by the TAC sensor to allow detection. This scanned path, in reference to FIG. 2, circumscribes the belt 10 and is essentially the region spotlighted by the original infrared beam 174 emitted by the TAC sensor 140 as the belt 10 is cycled during imaging. The permanent localized solid attribute 172 can be of any suitable shape. Typical shapes include, for example, circular, oval, square, rectangular, triangular, trapezoidal, star, and the like and should be at least equal to the size of the cross section of the infrared beam and located in the scanned path in order to suppress all strong optical reflections. For example, a 3.5 mm diameter beam can be used with an attribute that has a size and shape which at least wholly encompasses a 3.5 mm circle. Thus, the outer boundary of the attribute should encompass substantially all of the cross sectional area of the beam of monochromatic infrared radiation. Preferably, the permanent localized solid attribute has a circular shape and a diameter between about 1 millimeter and about 6 millimeters. The permanent localized solid attribute is created in the non imaging seam region 160, directly over the seam 134, on either side adjacent to the seam, or the like in order to avoid interference with the formation of images in the imaging region extending around the belt from adjacent the leading edge of the non imaging seam region to adjacent the trailing edge of the non imaging seam region. However, it is preferred that the solid attribute is located on the leading edge side of the non imaging seam region to yield best results. In accordance to the illustrations in FIG. 4 and FIG. 2, the expression "leading edge 166", as employed herein, is defined as the boundary at the side of the non imaging seam region 160 facing the direction toward which belt 10 travels. The expression "trailing edge 168", as employed herein, is defined as the side of the non imaging seam region facing the direction from which the belt travels. Both the imaging and non imaging regions of the photoreceptor belt are capable of providing uniform reflection upon exposure to monochromatic infrared radiation, except in the regions occupied by the permanent localized solid attribute, the seam, and belt imperfections such as scratches. The TAC sensor 140 can satisfactorily be positioned in any suitable location over the photoreceptor belt 10 other than the ground strip area. However, the mid section of the belt is a convenient location of choice. The permanent localized solid attribute remains permanently in place in the non imaging seam region from one imaging cycle to the next for the life of the belt. The attribute is solid in that, unlike a hole extending from one surface of the belt to the opposite surface, no physical object can pass through the belt at the location of the attribute.

FIGS. 5, 6, 7, and 8 are partial schematic cross-sectional views of photoreceptor belt embodiments similar to that shown in FIG. 2, with the exception that each belt has a unique permanent localized solid attribute created inside the non imaging seam region 160 and does not have a timing hole 130 in the ground strip 132 nor require a dedicated sensor 136 as shown in the illustration of FIG. 4. More specifically, the belt of FIG. 5 has an embossed permanent localized solid attribute 176; the belt of FIG. 6 has a permanent localized solid attribute in the form of a dark infrared absorbing overcoat attribute 178; the belt of FIG. 7 has a permanent localized solid attribute in the form of a crater 180 in the upper surface of the belt; and the belt of FIG. 8 has a permanent localized solid attribute in the form of a crater 182 in the lower surface of the belt. All of these permanent localized solid attributes are located on the leading edge area of the non imaging seam region 160 adjacent to the belt seam of the belt and in the scanning path of the infrared beam emitted from TAC sensor 140, to effect suppression of the infrared light directly reflected from the belt to the TAC sensor thereby facilitating accurate registration of images only in the imaging region of the photoreceptor belt and not in the non imaging seam region. The expressions "directly reflected" and "direct reflections", as employed herein, are defined as the portion of the reflected radiation striking the detector component in the TAC sensor. In other words, the reflected radiation seen or sensed by the detector component in the TAC sensor is the "directly reflected" radiation or "direct reflections". Since the "eye" of the detector component (e.g. photodiode) in the TAC sensor can vary from one design to another design, the dimensions of the cross sectional area of the reflected beam seen by the eye can also vary with the particular design selected.

Figure 5:
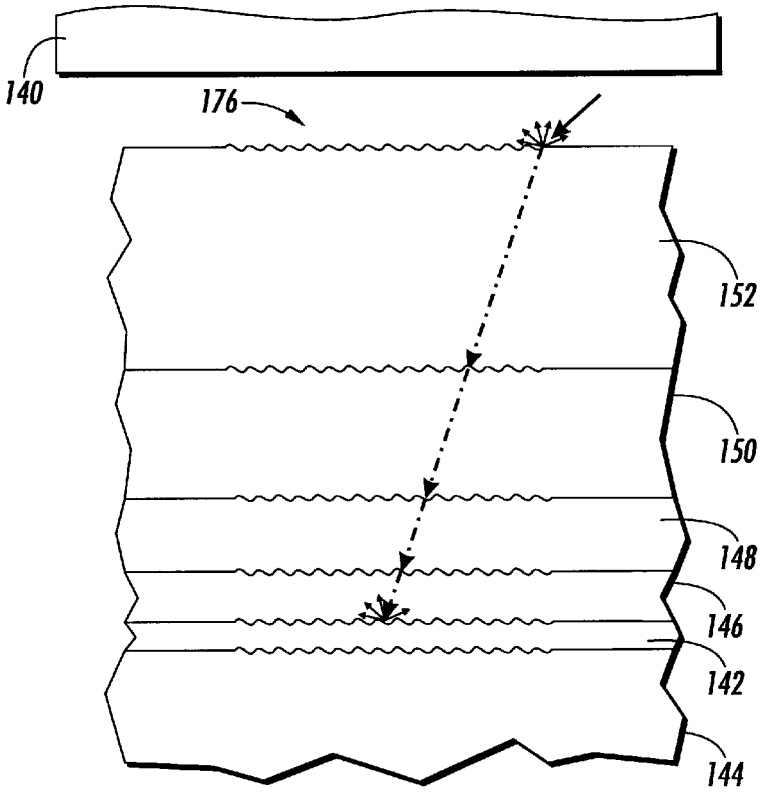
FIG. 5 is a partial schematic cross-sectional view of the photoreceptor belt similar to that of FIG. 2 with an embossed localized solid attribute in the seam region and adjacent to the seam, for suppressing direct light reflection by a scattering effect and for facilitating accurate image registration.

The embossed permanent localized solid attribute 176 illustrated in FIG. 5 may be created by any suitable combination of heat and pressure. For example, a die having a heated head carrying a shaped embossing pattern may be pressed against the upper surface of the belt at a predetermined location in the imaging region adjacent the seam. The embossing pattern may comprise sufficient roughness in the form of ridges or hills and valleys to deflect or scatter the TAC infrared radiation originally directed toward the permanent localized solid attribute. The light scattering power of the localized solid attribute should suppress reflection to a level where the detected directly reflected infrared radiation from the solid attribute is at least 50 percent less than the infrared radiation directly reflected from the photoreceptor belt seam itself. A typical ridge and valley pattern may comprise, for example, ridges having a peak height of from about 0.5 micrometer to about 50 micrometers above an imaginary plane extending through the bottom of the valleys and a peak to peak separation distance of between about 10 and 200 micrometers. The embossed pattern of the permanent solid attribute may be formed on the top layer, an intermediate layer, a plurality layers or all layers of the photoreceptor belt including the reflective electrically conductive ground plane layer 142 (which normally results in the same embossed pattern forming on the adjacent substrate layer 144 because conductive layer 142 is very thin), hole blocking layer 146, adhesive layer 148, charge generation layer 150 and charge transport layer 152. Embossing may be accomplished after the formation of the layer to be embossed, the highly reflective conductive ground plane 142 in particular, but prior to the application of overlying layers. The embossed pattern formed on these layers of the photoreceptor belt should be sufficiently rough to suppress direct reflection to the detector of the TAC sensor by at least about 50 percent of that which would normally be reflected directly back to the TAC sensor by the seam alone. Instead of employing a heat/pressure embossing process to form a rough permanent localized solid attribute pattern, any other suitable technique such as sand blasting, abrasive member contact, and the like may be utilized to create a rough surface sufficient to attenuate the infrared radiation reflected from the permanent localized solid attribute directly to the detector of the TAC sensor to a level which ensures positive identification of the attribute during continuously repeated electrophotographic imaging cycles. These alternative processes may be used to treat one or more of the layers of the photoreceptor belt such as the reflective electrically conductive ground plane layer 142, hole blocking layer 146, adhesive layer 148, charge generation layer 150 and charge transport layer 152.

Figure 6:
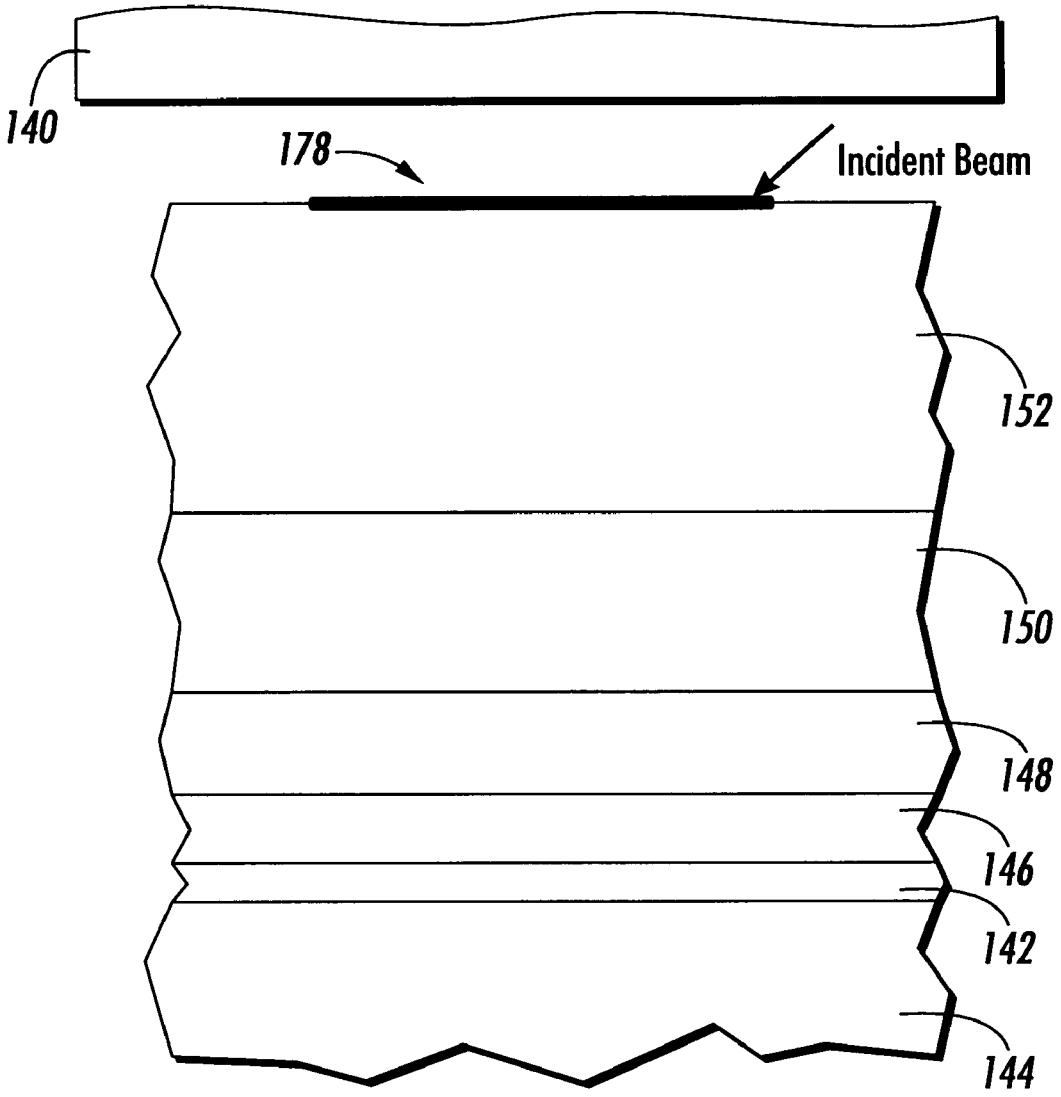
FIG. 6 is a partial schematic cross-sectional view of the photoreceptor belt of FIG. 2 with a black paint overcoated localized solid attribute, in the seam region and adjacent to the seam, for suppressing direct light reflection by absorption and for facilitating accurate image registration.
Figure 8:
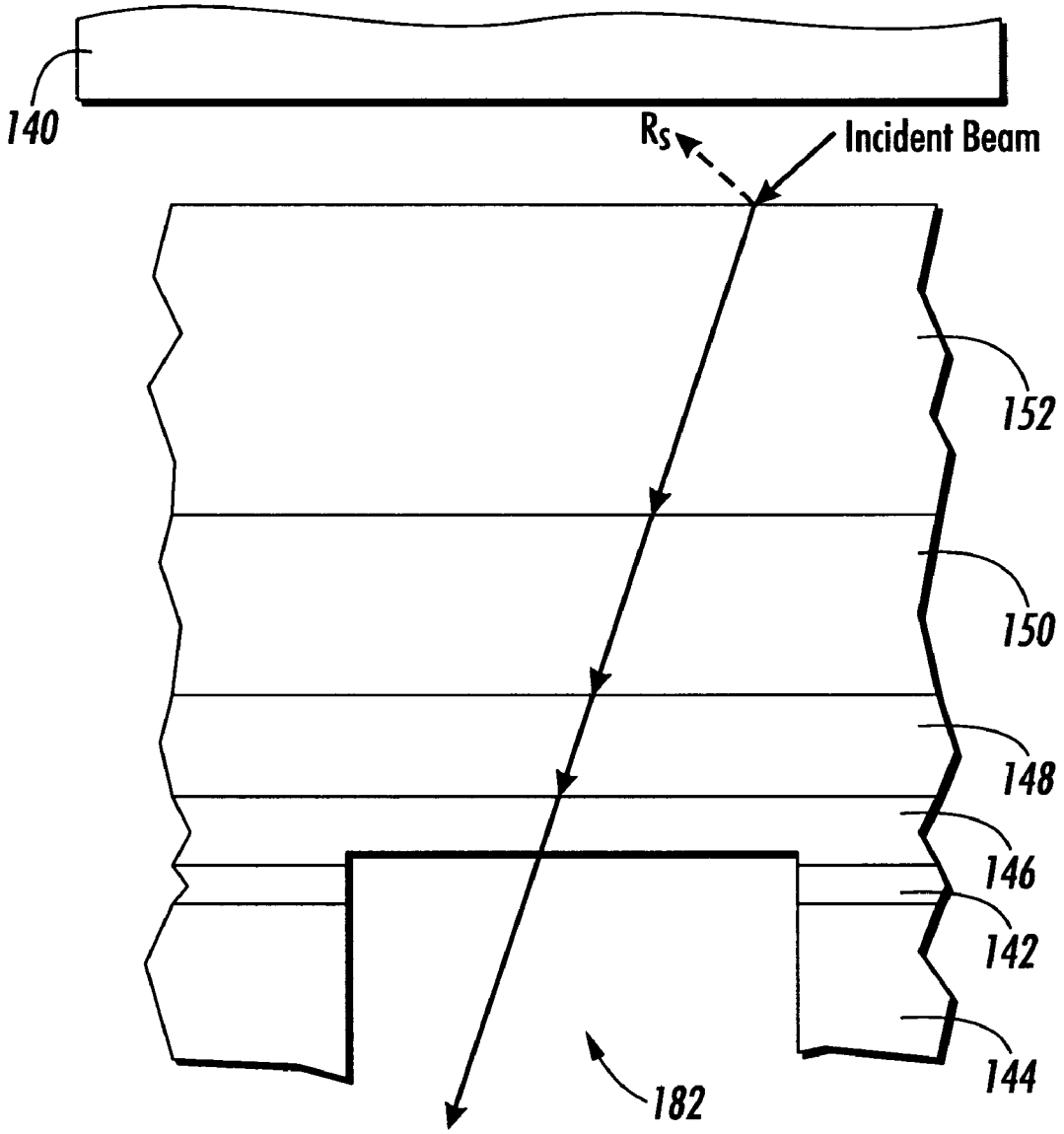
FIG. 8 is a partial schematic cross-sectional view of the photoreceptor belt of FIG. 2 with a localized solid attribute comprising a circular shaped crater in the back side of the belt in the seam region and adjacent to the seam, for suppressing direct light reflection by removing the reflective metal ground plane and for facilitating accurate image registration.
Figure 9:
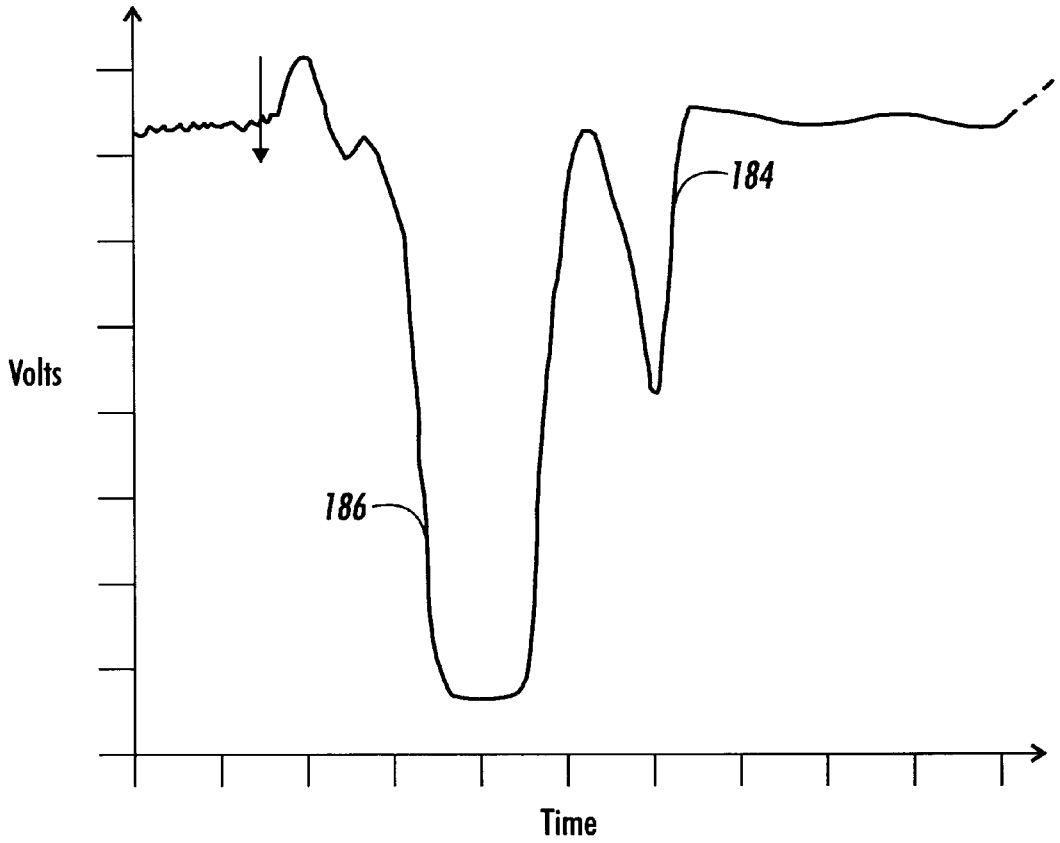
FIG. 9 is a graph illustrating voltage readings, corresponding to the direct reflections from the localized solid attribute of FIG. 7, detected by a toner area coverage sensor which is used to positively identify the seam area of a photoreceptor belt.

The permanent localized solid attribute in the form of a dark infrared absorbing overcoat attribute 178 shown in FIG. 6 may comprise any suitable infrared absorbing coating material. For example, the dark infrared absorbing overcoat attribute may be a black paint spot formed by forming coating of a polymer solution containing any suitable black pigment or dye, such as a carbon black dispersion, near the seam. Sufficient infrared radiation striking this permanent localized solid attribute should be absorbed by the attribute to reduce the amount of infrared radiation reflected directly back to the detector of the TAC sensor to at least about 50 percent of infrared radiation normally reflected directly back to the detector of the TAC sensor from the seam alone. Alternatively, the solid overcoat attribute 178 may comprise a light scattering coating containing dispersed reflective particles such as spheres, irregularly shaped particles, and the like having a refractive index sufficiently different from that of the matrix polymer binder to scatter enough reflected infrared radiation from the permanent solid overcoat attribute whereby the amount of radiation reflected directly back to the detector of the TAC sensor is less than about 50 percent of the radiation normally reflected directly back to the detector of the TAC sensor from the seam itself. Permanent localized solid attributes in the form of the craters illustrated in FIGS. 7 and 8 may be created by laser ablation using an excimer laser to remove layers in the photoreceptor including the key reflective electrically conductive layer 142 to enhance detect of the permanent localized solid attribute. Alternatively, the crater can be created by any other suitable technique such as acid etching, mechanical drilling and the like. If desired, the laser treatment may be used to remove a layer such as the reflective electrically conductive ground plane layer 142 prior to the application of all overlying layers. In one embodiment of the present invention a photoreceptor belt having a permanent localized solid attribute 182 in the shape of a circular crater (similar to the crater shown in FIG. 8) created, using an excimer laser, in the back side of the non imaging seam region and on the leading edge side adjacent to the seam, as described with reference to FIG. 4, was cycled in an electrophotographic imaging machine similar to that of FIG. 1. A beam of monochromatic infrared radiation emitted from the TAC sensor was directed onto the photoreceptor belt along a path defined by the monochromatic infrared radiation emitted from the TAC sensor, the path extending over the attribute during cycling. The TAC sensor was also used to measure the monochromatic infrared radiation reflected directly by the photoreceptor belt along the path. Since the key reflective electrically conductive ground plane layer 142 was removed, most of the monochromatic infrared radiation emitted from the TAC sensor passes through all the remaining infrared transparent layers above the crater attribute, thereby suppressing reflection of the radiation back to the detector of the TAC sensor. A voltage signal output from the TAC sensor representing the amount of directly reflected infrared radiation detected by the detector of the TAC sensor was fed to the control computer in the machine. Illustrated in FIG. 9 is a graph of this voltage signal output during the first belt rotation cycle prior to the image formation process. This reference signal is free from any toner signal interference and is used as the fingerprint stored in the controller logic for positive solid attribute identification and location registration for subsequent belt image formation cycling. The voltage suppression peaks 184 and 186 correspond to the direct reflectance signals received by the detector of the TAC sensor for the seam and the crater slot, respectively. It is clear that the permanent localized solid attribute of this invention provides a strong, unmistakable signal, like a fingerprint, for locating the attribute and its adjacent belt seam. A seamed photoreceptor belt having any one of the permanent localized solid attribute embodiments of the present invention may be employed in any suitable conventional electrophotographic imaging system utilizing a TAC sensor and charging prior to imagewise exposure to activating electromagnetic radiation.

A typical method for differentiating the permanent localized solid attribute in the seam area from noise in voltage signals from the TAC involves performing a Fast Fourier Transform (Fft R(×)=R(f), I(f)) on the suspected seam regions and generate their Power Spectrums. This produces a unique frequency signature for each region. A comparison to the actual seam area permanent localized solid attribute signature previously programmed into the controller results in location of the actual seam. Once the seam location is identified, the center of moment of the curve of FIG. 9 is calculated. This point, which is representative of the centerline of the non imaging seam region is then used as the registration point from which image pitch reset signals are generated by the controller to properly locate image frames for registration on the belt and subsequent toner image transfer to a receiving member.

Thus, there is provided an improved device, system and method for locating and tracking the seam area marking of an electrostatographic belt in an imaging machine. A conventional TAC Sensor is used to create a profile of the belt along its entire length by directing during cycling at least one beam of monochromatic infrared radiation onto the imaging region of the belt along a path which extends over the permanent localized solid attribute during cycling. The signal from the TAC varies as a function of belt reflectance and is substantially constant except for the area occupied by the permanent localized solid attribute in the non imaging seam region and, to a lesser extent, the area occupied by the seam. Any suitable algorithm may be used to filter out noise caused by the seam, scratches or dirt on the belt so that the permanent localized solid attribute can readily be located for accurate tracking of the centerline of the seam area. Image pitch reset signals are generated based on these readings so that electrostatic latent images are not produced in the non imaging seam region.

The invention will now be described in detail with respect to specific preferred embodiments thereof, it being noted that these examples are intended to be illustrative only and are not intended to limit the scope of the present invention. Parts and percentages are by weight unless otherwise indicated.

EXAMPLE I

An electrophotographic imaging member web was prepared by providing a roll of titanium coated biaxially oriented thermoplastic polyester (MELINEX® 442, available from ICI Americas, Inc.) substrate having a thickness of about 3 mils (76.2 micrometers) and applying thereto, using a gravure applicator, a solution containing 50 parts by weight 3-aminopropyltriethoxysilane, 50.2 parts by weight distilled water, 15 parts by weight acetic acid, 684.8 parts by weight of 200 proof denatured alcohol, and 200 parts by weight heptane. This blocking layer had a dry thickness of about 0.05 micrometer.

An adhesive interface layer was then prepared by applying to the blocking layer a wet coating containing 5 percent by weight, based on the total weight of the solution, of polyester adhesive (MOR-ESTER® 49,000, available from Morton International, Inc.) in a 70:30 volume ratio mixture of tetrahydrofuran/cyclohexanone. The adhesive interface layer had a dry thickness of about 0.07 micrometers.

The adhesive interface layer was thereafter coated with a photogenerating layer containing 7.5 percent by weight volume trigonal selenium, 25 percent by volume N,N'-diphenyl-N,N'-bis(3-methylphenyl)-1,1'biphenyl-4,4'-diamine, and 67.5 percent by volume polyvinylcarbazole. This photogenerating layer was prepared by introducing 160 grams polyvinylcarbazole and 2,800 milliliters of a 1:1 volume ratio of a mixture of tetrahydrofuran and toluene into a 400 oz. amber bottle. To this solution was added 160 grams of trigonal selenium and 20,000 grams of ⅛ inch (3.2 millimeters) diameter stainless steel shot. 500 grams of the resulting slurry were added to a solution of 36 grams of polyvinylcarbazole and 20 grams of N,N'-diphenyl-N,N'-bis (3-methylphenyl)-1,1'biphenyl-4,4'-diamine dissolved in 750 milliliters of 1:1 volume ratio of tetrahydrofuran/toluene. This slurry was thereafter applied to the adhesive interface by extrusion coating to form a layer having a wet thickness of about 0.5 mil (12.7 micrometers). However, a strip about 3 mm wide along one edge of the coating web, having the blocking layer and adhesive layer, was deliberately left uncoated without any of the photogenerating layer material to facilitate adequate electrical contact by a ground strip layer that is applied later. This photogenerating layer was dried in a forced air oven to form a dry thickness photogenerating layer having a thickness of about 2.0 micrometers.

This coated imaging member web was simultaneously overcoated with a charge transport layer and a ground strip layer by co-extrusion of the coating materials. The charge transport layer was prepared by introducing into an amber glass bottle in a weight ratio of 1:1 N,N'diphenyl-N,N'-bis (3-methylphenyl)-1,1'-biphenyl-4,4'-diamine and MAKROLON® 5705, a polycarbonate resin having a molecular weight of about 120,000 and commercially available from Farbensabricken Bayer A. G. The resulting mixture was dissolved to give 15 percent by weight solid in methylene chloride. This solution was applied on the photogenerating layer by extrusion to form a coating which upon drying gave a thickness of about 24 micrometers.

The strip, about 3 mm wide, of the adhesive layer left uncoated by the photogenerator layer, was coated with a ground strip layer during the co-extrusion process. The ground strip layer coating mixture was prepared by combining 23.81 grams of polycarbonate resin (MAKROLON® 5705, 7.87 percent by total weight solids, available from Bayer A. G.), and 332 grams of methylene chloride in a carboy container. The solution was mixed for about 15 to about 30 minutes with about 93 grams of a graphite dispersion (12.3 percent by weight solids) of 9.41 parts by weight graphite, 2.87 parts by weight ethyl cellulose and 87.7 parts by weight solvent (Acheson Graphite dispersion RW22790, available from Acheson Colloids Company). The viscosity was adjusted with the aid of methylene chloride. This ground strip coating mixture was then applied, by co-extrusion with the charge transport layer, to the electrophotographic imaging member web to form an electrically conductive ground strip layer having a dried thickness of about 14 micrometers.

The resulting imaging member web containing all of the above layers was then passed through a maximum temperature zone of 240° F. (116° C.) in a forced air oven to simultaneously dry both the charge transport layer and the ground strip.

An anti-curl coating was prepared by combining 88.2 grams of polycarbonate resin (MAKROLON® 5705, available from Goodyear Tire and Rubber Company) and 900.7 grams of methylene chloride in a carboy container to form a coating solution containing about 8.9 percent solids. 4.5 grams of silane treated microcrystalline silica was dispersed in the resulting solution with a high shear dispersion to form the anti-curl coating solution. The anti-curl coating solution was then applied to the rear surface (side opposite the photogenerator layer and charge transport layer) of the electrophotographic imaging member web by extrusion coating and dried to a maximum temperature of 220° F. (104° C.) in a forced air oven to product a dried coating layer having a thickness of 13.5 micrometers.

EXAMPLE II

The electrophotographic imaging member web of Example I having a width of 353 millimeters, was cut to give four parallelogram sheets of about 559.5 millimeters in length. The opposite ends of each imaging member, having 4° skew, were overlapped 1 mm and joined by an ultrasonic energy seam welding process using a 40 kHz horn frequency to form a seamed electrophotographic imaging member belt.

The ultrasonically welded belt had two 1 mm seam splashes adjacent the 1 mm overlapped seam, one splash on the top surface of the belt over the charge transport layer and the other on the exposed surface of the back side of the belt over the anti-curl backing layer. The welded seam had a thickness about 75 micrometers greater than that of the main body of the belt when measured with a micrometer. This ultrasonic welded seam represents a typical seam configuration used for most flexible electrophotographic imaging member belts.

EXAMPLE III

The four seamed electrophotographic imaging member belts prepared in Example II were separately subjected to different unique seam region treatment processes to produce specific permanent localized solid attributes of this invention adjacent to the welded seam.

The seam area of the first imaging member belt was contacted with a die head heated to 230° C. at a pressure of 80 psi for 6 seconds to impart a 6 mm diameter textured circular spot (i.e., permanent localized solid attribute) 1 mm from the imaginary centerline of the seam and 183 mm from the outer edge of the ground strip of the belt to the center of the permanent localized solid attribute to effect light scattering as schematically illustrated in FIG. 5.

The seam area of the second imaging member belt was provided with a black, 6 millimeter diameter, light absorbing circular overcoat spot (i.e., permanent localized solid attribute) by applying a ground strip coating solution, prepared according to the procedure given in Example I, to the same seam location as described above. The black permanent localized solid attribute is schematically shown in FIG. 6.

Figure 7:
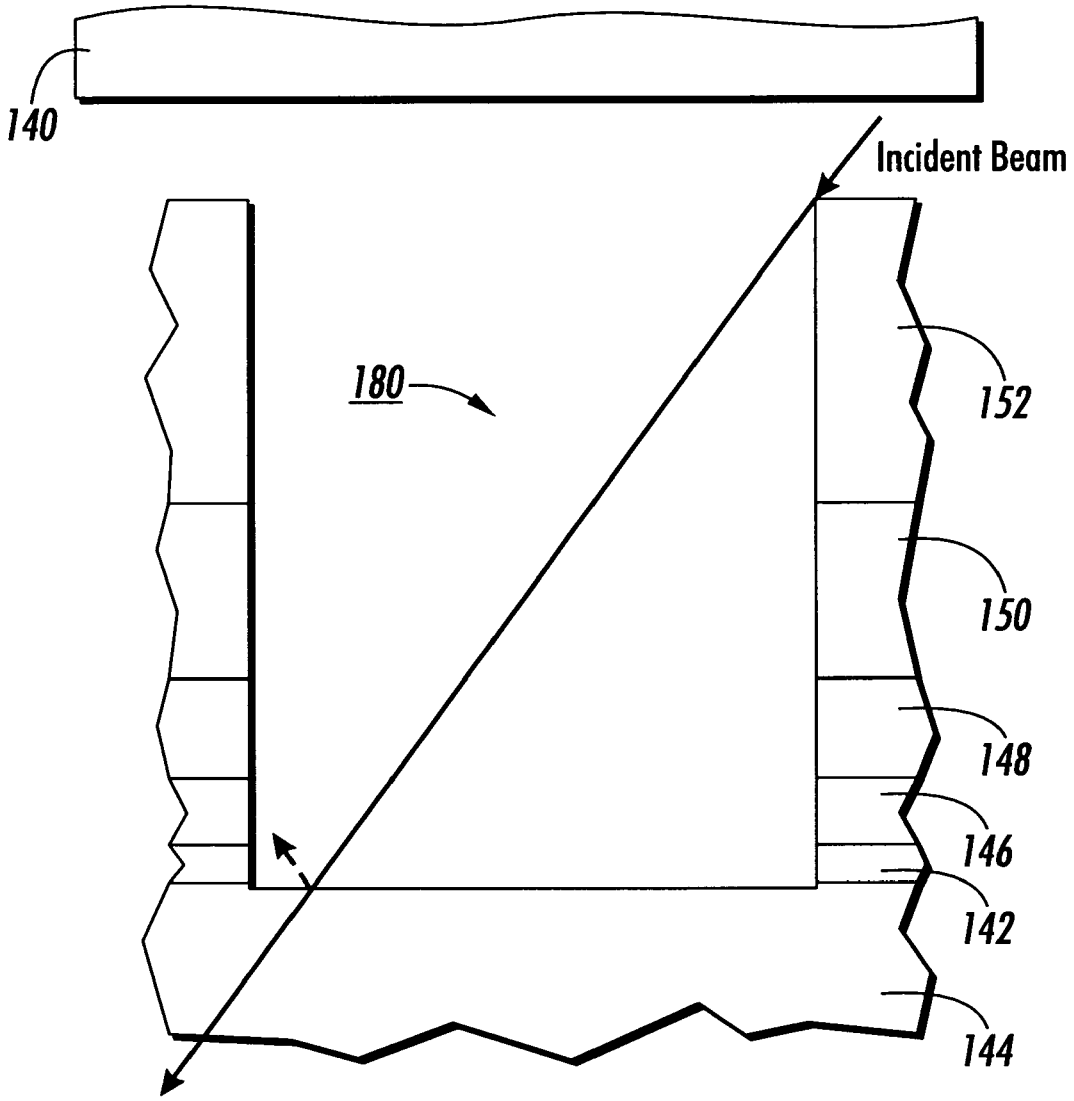
FIG. 7 is a partial schematic cross-sectional view of the photoreceptor belt of FIG. 2 with a localized solid attribute comprising a circular shaped crater in the imaging surface side of the belt in the seam region and adjacent to the seam, for suppressing direct light reflection by removing the reflective metal ground plane and for facilitating accurate image registration.

The seam area of the third imaging was treated with an excimer laser to create, by ablation, a 6 mm diameter circular crater (i.e., permanent localized solid attribute), in the top surface of the belt and at the same location as described above. The ablation treatment removed all the upper imaging coating layers and the conductive ground plane as well, thereby suppressing the direct light reflection as schematically illustrated in FIG. 7. The attribute was solid because the anti-curl backing layer and most of the biaxially oriented thermoplastic polyester substrate were not removed by laser ablation action and remained to form a continuous solid bottom for the crater. Thus, toner particles and other debris cannot pass thorough the photoreceptor belt at the location of the crater.

The seam area of the fourth imaging member belt was also treated with an excimer laser to create, by ablation, a 6 mm diameter circular crater (i.e., permanent localized solid attribute), in the bottom surface of the belt at the same location relative to the seam and edge of the belt as described above. The ablation treatment removed the anti-curl coating, substrate layer, and the conductive ground plane thereby suppressing direct light reflection as schematically illustrated in FIG. 8. The attribute was solid because the transport layer, generating layer, adhesive layer and some of the blocking layer remained to form the continuous solid top for the crater. Thus, toner particles and other debris cannot pass thorough the photoreceptor belt at the location of the crater.

The four electrophotographic imaging belts were tested by cycling at a belt transport speed of 302.25 mm per second in a xerographic imaging machine equipped with a black toner area coverage (TAC) sensor. Since the TAC sensor is situated with the center of a 6 mm diameter infrared beam 183 mm away from the imaging member belt outer ground strip edge and above the belt surface, the TAC sensor scanning path, when each belt is cycling, extends directly over the solid attribute of each belt to capture and read out reflection suppression as the permanent localized solid attribute passed under the TAC Sensor to signal the controller and effect accurate seam registration. The voltage signal corresponding to passage of a permanent localized solid attribute in the form of a crater in the back surface of the belt, as illustrated in FIG. 8, to suppress reflection is illustrated in FIG. 9.

It is, therefore, apparent that there has been provided in accordance with the present invention, an electrostatographic imaging belt having an improved seam area detection feature that fully satisfies the aims and advantages set forth above. While this invention has been described in conjunction with specific embodiments thereof, it is evident that many alternatives, modifications, and variations will be apparent to those skilled in the art. Accordingly, it is intend to embrace all such alternatives, modifications and variations that fall within the spirit and broad scope of the appended claims.

What is claimed is:

1. A flexible electrostatographic imaging belt having two parallel sides and a non imaging seam region extending substantially from one of the sides to the other side of the belt, the non imaging seam region having a leading edge, a trailing edge and a seam within the non imaging seam region, the leading and trailing edges being perpendicular to the two parallel sides of the imaging belt, the belt comprising a substrate layer, a reflective electrically conductive layer, at least one imaging layer, an imaging region extending around the belt from adjacent the leading edge of the seam region to adjacent the trailing edge, the imaging region adapted to reflect monochromatic infrared radiation and a permanent localized solid attribute at a predetermined location in the non imaging seam region, the attribute adapted to reduce by at least about 50 percent direct reflection by the seam of a beam of monochromatic infrared radiation originally directed at the attribute.

2. A flexible electrostatographic imaging belt according to claim 1 wherein the monochromatic infrared radiation has a wavelength greater than about 800 nanometers.

3. A flexible electrostatographic imaging belt according to claim 1 wherein the permanent localized solid attribute is located between the seam and the trailing edge of the seam region.

4. A flexible electrostatographic imaging belt according to claim 1 wherein the permanent localize solid attribute is located at least partly on the seam.

5. A flexible electrostatographic imaging belt according to claim 1 wherein the permanent localized solid attribute is located between the seam and the leading edge of the seam region.

6. A flexible electrostatographic imaging belt according to claim 1 wherein the permanent localized solid attribute has a circular shape.

7. A flexible electrostatographic imaging belt according to claim 1 wherein the permanent localized solid attribute is a monochromatic infrared radiation absorbing coating.

8. A flexible electrostatographic imaging belt according to claim 1 wherein the permanent localized solid attribute is a crater having a solid continuous bottom which transmits monochromatic infrared radiation.

9. A flexible electrostatographic imaging belt according to claim 8 wherein the belt comprises a charge transport layer, a charge generating layer, said reflective electrically conductive layer and a support layer and wherein the crater extends through the support layer and the reflective electrically conductive layer.

10. A flexible electrostatographic imaging belt according to claim 8 wherein the belt comprises a charge transport layer, a charge generating layer, said reflective electrically conductive layer and a support layer and wherein the crater extends through the charge transport layer, charge generating layer and reflective electrically conductive layer.

11. A flexible electrostatographic imaging belt according to claim 1 wherein the belt has an outer imaging surface and permanent localized solid attribute on the outer imaging surface, the attribute comprising an irregular surface pattern which disperses or scatters the monochromatic infrared radiation originally directed toward the imaging belt.

12. A flexible electrostatographic imaging belt according to claim 1 wherein the belt is an electrographic imaging member.

13. A flexible electrostatographic imaging belt according to claim 1 wherein the seam is straight and is perpendicular to the two parallel sides of the electrostatographic imaging belt.

14. A flexible electrostatographic imaging belt according to claim 1 wherein the attribute occupies an area of from about 10 square millimeters to an area occupying the entire non imaging seam region.

15. An electrostatographic imaging apparatus comprising a flexible electrostatographic imaging belt having two parallel sides and a non imaging seam region extending substantially from one of the sides to the other side of the belt, the non imaging seam region having a leading edge, a trailing edge, and a seam within the non imaging seam region, the leading and trailing edges being perpendicular to the two parallel sides of the imaging belt, the belt comprising a substrate layer, a reflective electrically conductive layer, at least one imaging layer, an imaging region extending around the belt from adjacent the leading edge of the seam to adjacent the trailing edge, the imaging region adapted to reflect monochromatic infrared radiation and a permanent localized solid attribute at a predetermined location in the non imaging seam region adjacent the seam, the attribute adapted to reduce by at least about 50 percent direct reflection by the seam of a beam of monochromatic infrared radiation originally directed at the attribute, at least one support for the belt, a drive to cycle the belt on the support, a device for forming an electrostatic latent image in the imaging region, a device for developing the electrostatic latent image to form a toner image in conformance with the electrostatic latent image and a device for transferring the toner image to a receiving member, a light source adapted to direct, during belt cycling, at least one beam of monochromatic infrared radiation onto the imaging region and seam region along a path which extends over the solid attribute during cycling, a device adapted to generate a signal upon detection of suppressed reflection of monochromatic infrared radiation reflected from the seam region when the beam strikes the solid attribute, and a device to process the signal to track the seam.

16. An electrostatographic imaging apparatus according to claim 15 wherein the device to process the signal to track the seam is a controller.

17. An electrostatographic imaging apparatus according to claim 15 wherein the electrostatic latent image is formed only in the imaging region.

18. An electrostatographic imaging apparatus according to claim 15 wherein the device adapted to generate a signal upon detection of reduced reflection of monochromatic infrared radiation reflected from the seam region when the beam strikes the solid attribute is a toner area coverage sensor.

19. An electrostatographic imaging process comprising providing a flexible electrostatographic imaging belt having two parallel sides and a non imaging seam region extending substantially from one of the sides to the other side, the non imaging seam region having a leading edge, a trailing edge, and a seam within the non imaging seam region, the leading and trailing edges being perpendicular to the two parallel sides of the imaging belt, the belt comprising a substrate layer, a reflective electrically conductive layer, at least one imaging layer, an imaging region extending around the belt from adjacent the leading edge of the seam to adjacent the trailing edge, the imaging region adapted to reflect monochromatic infrared radiation and a permanent localized solid attribute at a predetermined location in the non imaging seam region adjacent the seam, the attribute adapted to reduce by at least about 50 percent direct reflection by the seam itself of a beam of monochromatic infrared radiation originally directed at the attribute, cycling the belt in an electrostatographic imaging process comprising forming an electrostatic latent image in the imaging region, developing the electrostatic latent image to form a toner image in conformance with the electrostatic latent image and transferring the toner image to a receiving member, directing during cycling at least one beam of monochromatic infrared radiation onto the imaging region and the non imaging seam region along a path which extends over the solid attribute during cycling, detecting the suppression of monochromatic infrared radiation directly reflected from the non imaging seam region when the beam strikes the solid attribute, generating a signal when the directly reflected monochromatic infrared radiation is suppressed, and processing the signal to track the attribute.

20. An electrostatographic imaging process according to claim 19 including tracking the attribute as a registration point for image pitch reset signals to position electrostatic latent image frames only in the imaging region.

21. An electrostatographic imaging process according to claim 19 wherein the beam of monochromatic infrared radiation has a circular cross sectional shape and a diameter between about 1 millimeter and about 6 millimeters.

* * * * *